US007984619B2

(12) United States Patent
Matsui

(10) Patent No.: US 7,984,619 B2
(45) Date of Patent: Jul. 26, 2011

(54) AIR CONDITIONING SYSTEM

(75) Inventor: Nobuki Matsui, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 634 days.

(21) Appl. No.: 11/921,239

(22) PCT Filed: May 25, 2006

(86) PCT No.: PCT/JP2006/310429

§ 371 (c)(1),
(2), (4) Date: Nov. 29, 2007

(87) PCT Pub. No.: WO2006/129544

PCT Pub. Date: Dec. 7, 2006

(65) Prior Publication Data

US 2009/0038326 A1 Feb. 12, 2009

(30) Foreign Application Priority Data

May 30, 2005 (JP) ..... 2005-157719

(51) Int. Cl.
*F25D 23/00* (2006.01)

(52) U.S. Cl. ..... 62/271; 62/324.1

(58) Field of Classification Search ..... 62/324.1–324.6, 62/271, 94

See application file for complete search history.

(56) References Cited

U.S. PATENT DOCUMENTS

| | | | | |
|---|---|---|---|---|
| 2005/0155362 | A1* | 7/2005 | Shah | 62/176.6 |
| 2006/0196195 | A1 | 9/2006 | Ikegami et al. | |

FOREIGN PATENT DOCUMENTS

| | | | |
|---|---|---|---|
| EP | 1480113 | * | 8/2004 |
| GB | 2 253 478 | A | 9/1992 |
| JP | 7-269894 | A | 10/1995 |
| JP | 2002-317990 | A | 10/2002 |
| JP | 2003-314856 | A | 11/2003 |
| JP | 2004-294048 | A | 10/2004 |
| JP | 2005-114294 | A | 4/2005 |
| JP | 2005-134005 | A | 5/2005 |

* cited by examiner

*Primary Examiner* — Mohammad Ali

(74) *Attorney, Agent, or Firm* — Birch, Stewart, Kolasch & Birch, LLP.

(57) ABSTRACT

Heat exchangers of a refrigerant circuit 50 are constructed of a first adsorption heat exchanger 51 and a second adsorption heat exchanger 52, both of which have an adsorbent supported thereon, and are constructed so as to be switched into an evaporator and a condenser. An air passage 60 is constructed so as to be switched into states in which air flowing from the outside of a room to the inside of the room and air flowing from the inside of the room to the outside of the room flow through either of the first adsorption heat exchanger 51 and the second adsorption heat exchanger 52. A dehumidifying operation mode and a humidifying operation mode can be performed by switching the flow of refrigerant and the flow of air at specified intervals, a cooling operation mode and a heating operation mode can be performed without switching the flow of refrigerant and the flow of air, and an ventilating operation mode can be performed by flowing air through the air passage 60 in a state where the refrigerant circuit 50 is stopped.

10 Claims, 11 Drawing Sheets

First air
Second air

RA
SA
OA
EA
10
11
12
13
16
17
18
21
22
23
24
25
26
31
32
33
34
35
36
37
38
41
42
43
44
45
46
47
48
51
52
53
60
(61)
60
(62)

First air
Second air

RA
SA
OA
EA
10
11
12
13
16
17
18
21
22
23
24
25
26
31
32
33
34
35
36
37
38
41
42
43
44
45
46
47
48
51
52
53
60
(61)
(62)

First air
Second air

RA
SA
OA
EA
10
11
12
13
16
17
18
21
22
23
24
25
26
31
32
33
34
35
36
37
38
41
42
43
44
45
46
47
48
51
52
53
60
(61)
(62)

First air
Second air

RA
SA
OA
EA
10
11
12
13
16
17
18
21
22
23
24
25
26
31
32
33
34
35
36
37
38
41
42
43
44
45
46
47
48
51
52
53
60
(61)
(62)

First operation

Second operation

AIR CONDITIONING SYSTEM

TECHNICAL FIELD

The present invention relates to an air conditioning system and, in particular, to an air conditioning system of a construction using a condenser and an evaporator (or a heater and a cooler corresponding to them) of a refrigerant circuit and an adsorbent capable of adsorbing moisture in air and releasing moisture into air.

BACKGROUND ART

As an air conditioning system of this kind has been proposed an air conditioning system in which a refrigerant circuit of a vapor compression type refrigeration cycle is provided with not only two air heat exchangers (outdoor heat exchanger and indoor heat exchanger) for exchanging heat between refrigerant and air but also two adsorption heat exchangers (heat exchanger having adsorbent supported on the surfaces of fins of an air heat exchanger), the indoor heat exchanger and two adsorption type heat exchanges being disposed in an indoor unit, the outdoor heat exchanger being disposed in an outdoor unit (for example, see patent document 1).

In this air conditioning system, moisture in air is adsorbed by the adsorbent in the adsorption heat exchanger acting as an evaporator and moisture is released from the adsorbent in the adsorption heat exchanger acting as a condenser. Thus, a latent heat load in the room can be treated by supplying air dehumidified by the adsorption heat exchanger or air humidified by the adsorption heat exchanger to the inside of the room. On the other hand, air is cooled or heated in the indoor heat exchanger. Thus, a sensible heat load in the room can be treated by supplying air cooled by the indoor heat exchanger or air heated by the indoor heat exchanger to the inside of the room.

In this regard, this air conditioning system is constructed so as to perform also an ventilating operation of supplying air taken into from the outside of the room to the inside of the room through one of the adsorption heat exchangers and of discharging air taken into from the inside of the room to the outside of the room through the other adsorption heat exchanger.

[Patent document 1]: Japanese Unexamined Patent Publication No. 2005-114294

DISCLOSURE OF THE INVENTION

Problems that the Invention is to Solve

However, in the above-mentioned air conditioning system, the refrigerant circuit needs to have four heat exchangers. Thus, this presents a problem that the construction of the system becomes complicated.

Moreover, when the dehumidifying operation of supplying air passing through the adsorption heat exchanger acting as an evaporator to the inside of the room is performed, also the indoor heat exchanger acts as an evaporator and hence the dehumidifying operation is brought to a dehumidifying and cooling operation in which the dehumidifying operation and a cooling operation are performed at the same time. Thus, when the dehumidifying operation and the cooling operation needs to be separately performed, one of the heat exchangers needs to be stopped, which presents a problem that the construction of the system is further complicated. Furthermore, when the humidifying operation of supplying air passing through the adsorption heat exchanger acting as a condenser to the inside of the room is performed, also the indoor heat exchanger acts as a condenser and hence the humidifying operation is brought to a humidifying and heating operation in which the humidifying operation and a heating operation are performed at the same time. Thus, when the humidifying operation and the heating operation needs to be separately performed, similarly, one of the heat exchangers needs to be stopped, which presents a problem that the construction of the system is further complicated.

In this manner, the conventional air conditioning system using the adsorption heat exchangers presents not only a problem that the construction of the system becomes a complicated construction requiring four heat exchangers but also a problem that when the air conditioning system needs to respond to a variety of operation modes, the construction of the system becomes more complicated.

The present invention has been made in view of these problems. The object of the present invention is to prevent an air conditioning system, which uses a condenser and an evaporator of a refrigerant circuit (or a heater and a cooler corresponding to them) and an adsorbent capable of adsorbing moisture in air and releasing moisture into the air, from becoming complicated in the construction of the system and to make the air conditioning system respond to a variety of operation modes.

Means for Solving the Problems

A first aspect of the present invention is predicated on an air conditioning system including: an air passage 60 having a first passage 61 in which outdoor air flows to an inside of a room and a second passage 62 in which room air flows to an outside of the room; a refrigerant circuit 50 for performing a vapor compression type refrigeration cycle; and an adsorbent capable of adsorbing moisture in air and releasing moisture into the air.

This air conditioning system is characterized by being constructed in the following manner.

First, a heat exchanger of the refrigerant circuit 50 is constructed of a first adsorption heat exchanger 51 and a second adsorption heat exchanger 52 which have an adsorbent supported on their surfaces, and the refrigerant circuit 50 is constructed so as to be able to switch between a first refrigerant flowing state, in which the first adsorption heat exchanger 51 acts as an evaporator and in which the second adsorption heat exchanger 52 acts as a condenser, and a second refrigerant flowing state, in which the second adsorption heat exchanger 52 acts as an evaporator and in which the first adsorption heat exchanger 51 acts as a condenser. The air passage 60 is constructed so as to be able to switch between a first air flowing state, in which air flowing from the outside of the room to the inside of the room passes through the first adsorption heat exchanger 51 and in which air flowing from the inside of the room to the outside of the room passes through the second adsorption heat exchanger 52, and a second air flowing state, in which the air flowing from the outside of the room to the inside of the room passes through the second adsorption heat exchanger 52 and in which the air flowing from the inside of the room to the outside of the room passes through the first adsorption heat exchanger 51.

Further, this air conditioning system is constructed so as to be able to perform: a dehumidifying operation mode and a humidifying operation mode which are performed by switching the refrigerant flowing state and the air flowing state at specified intervals; a cooling operation mode and a heating operation mode which are performed not by switching but by fixing the refrigerant flowing state and the air flowing state; and a ventilating operation mode which is performed by flowing air through the air passage 60 in a state where the refrigerant circuit 50 is stopped.

In this first aspect of the present invention, the dehumidifying operation mode can be performed by switching a first operation and a second operation alternately at specified intervals, the first operation performing the second refrigerant flowing state and the second air flowing state at the same time, the second operation performing the first refrigerant flowing state and the first air flowing state at the same time. Moreover, the humidifying operation mode can be performed by switching a first operation and a second operation alternately at specified intervals, the first operation performing the second refrigerant flowing state and the first air flowing state at the same time, the second operation performing the first refrigerant flowing state and the second air flowing state at the same time.

The cooling operation mode can be performed by selecting either the first operation or the second operation of the dehumidifying operation mode and by performing the selected operation continuously. In other words, the adsorbent adsorbs moisture at the beginning of adsorption and is brought into a saturated state in a short time and ceases to treat latent heat, so the adsorption heat exchangers 51, 52 can be thereafter used as heat exchangers for treating sensible heat to thereby perform the cooling operation. Moreover, the heating operation mode can be performed by selecting either the first operation or the second operation of the humidifying operation mode and by performing the selected operation continuously. Also in this case, the adsorbent releases moisture at the beginning and ceases to release the moisture in a short time and ceases to treat latent heat, so the adsorption heat exchangers 51, 52 can be thereafter used as heat exchangers for treating sensible heat to thereby perform the heating operation.

The ventilating operation mode can be performed by flowing air through the first passage 61 and the second passage 62 in a state in which the refrigerant circuit 50 is stopped. Specifically, the flow of air in the first operation of the dehumidifying operation mode (cooling operation mode) is the same as the flow of air in the second operation of the humidifying operation mode (heating operation mode), and the flow of air in the second operation of the dehumidifying operation mode (cooling operation mode) is the same as the flow of air in the first operation of the humidifying operation mode (heating operation mode). Thus, the interior of the room can be ventilated by selecting either the first operation or the second operation or by switching between the first operation and the second operation.

A second aspect of the present invention is characterized in that the first invention includes control means 70 that determines an optimal operation mode on the basis of at least a state quantity of the room air and a state quantity of the outdoor air and sets an operation mode.

According to this second aspect of the present invention, which operation mode of the dehumidifying operation mode, the humidifying operation mode, the cooling operation mode, the heating operation mode, and the ventilating operation is required can be determined by the control means 70 on the basis of the state quantity such as the temperature or humidity of the room air and the state quantity such as the temperature or humidity of the outdoor air, and an operation suitable for an outdoor state and an indoor state can be performed.

A third aspect of the present invention is characterized in that in the second aspect of the present invention, the control means 70 is constructed so as to be able to perform the dehumidifying operation mode when an outside air humidity is higher than an upper limit of a set humidity and to perform the humidifying operation mode when the outside air humidity is lower than a lower limit of the set humidity.

According to the third aspect of the present invention, when the outdoor air humidity is higher than the upper limit of the preset humidity, the determination whether or not the dehumidifying operation mode is to be started can be made, and when the outdoor air humidity is lower than the lower limit of the preset humidity, the determination whether or not the humidifying operation mode is to be started can be made. For example, the dehumidifying operation mode is normally performed under a condition in which the outside air humidity is high, but when an outside air temperature is low, if the dehumidifying operation is performed, the room temperature can become too low, so in this case the dehumidifying operation mode may be not performed but the ventilating operation may be performed. Similarly, the humidifying operation mode is normally performed under a condition in which the outside air humidity is low, but when the outside air temperature is high, if the humidifying operation is performed, the room temperature can become too high, so in this case the humidifying operation mode may be not performed but the ventilating operation may be performed.

A fourth aspect of the present invention is characterized in that in the second aspect of the present invention or in the third aspect of the present invention, the control means 70 is constructed so as to be able to perform the cooling operation mode and the heating operation mode when the outside air humidity is between the upper limit and the lower limit of the set humidity.

According to the fourth aspect of the present invention, when it is determined that the outside air humidity is between the upper limit and the lower limit of the preset humidity, the determination whether or not the cooling operation mode and the heating operation mode are to be started can be made. In this case, depending on the condition, the cooling operation mode, the heating operation mode, or the ventilating operation mode can be selected.

A fifth aspect of the present invention is characterized in that in the fourth aspect of the present invention, the control means 70 is constructed so as to set the cooling operation mode when an room temperature is lower than an outdoor temperature and is higher than a set temperature and to set the heating operation mode when the room temperature is higher than the outdoor temperature and is lower than the set temperature.

According to the fifth aspect of the present invention, the conditions in which the cooling operation mode and the heating operation mode are performed are determined. In other words, when the outdoor air humidity is between the upper limit and the lower limit of the preset humidity and the room temperature is lower than the outdoor temperature and the room temperature is higher than the set temperature, the cooling operation mode is set. Moreover, when the outdoor air humidity is between the upper limit and the lower limit of the preset humidity and the room temperature is higher than the outdoor temperature and the room temperature is lower than the set temperature, the heating operation mode is set.

A sixth aspect of the present invention is characterized in that in the fifth aspect of the present invention, the control means 70 is constructed so as to set an evaporation temperature of the refrigerant circuit 50 in the cooling operation mode higher than a dew-point temperature of the outdoor air and to set the evaporation temperature of the refrigerant circuit 50 in the heating operation mode higher than a dew-point temperature of the room air.

When the evaporation temperature of the refrigerant circuit 50 in the cooling operation mode is lower than the dew-point temperature of the outdoor air and the evaporation temperature of the refrigerant circuit 50 in the heating operation mode is lower than the dew-point temperature of the room air, there is a possibility that drain water will be produced in the adsorption heat exchangers 51, 52. On the other hand, according to this sixth aspect of the present invention, by controlling the evaporation temperature of the refrigerant circuit 50 in advance, the production of the drain water can be prevented.

A seventh aspect of the present invention is characterized in that in the fifth aspect of the present invention or the sixth aspect of the present invention, when the evaporation temperature of the refrigerant circuit 50 in the cooling operation mode reaches a target value and then a difference between a high pressure and a low pressure of the refrigerant circuit 50 is smaller than a specified pressure difference, a compressor 53 of the refrigerant circuit 50 is stopped to prohibit the cooling operation mode, and when the evaporation temperature of the refrigerant circuit 50 in the heating operation mode reaches a target value and then the difference between the high pressure and the low pressure of the refrigerant circuit 50 is smaller than the specified pressure difference, the compressor 53 of the refrigerant circuit 50 is stopped to prohibit the heating operation mode.

According to the seventh aspect of the present invention, even if the evaporation temperature of the refrigerant circuit 50 reaches the target value in the cooling operation mode and in the heating operation mode, when a pressure difference required in the refrigerant circuit 50 cannot be acquired because of the outside air condition, an appropriate operation cannot be performed and hence the compressor 53 is stopped.

An eighth aspect of the present invention is characterized in that: in the fifth, sixth, or seventh aspect of the present invention, the compressor 53 of the refrigerant circuit 50 is constructed of a variable displacement compressor 53; the compressor 53 is stopped to prohibit the cooling operation mode under a condition in which the evaporation temperature of the refrigerant circuit 50 is lower than a dew-point temperature of the outdoor air in a state where the compressor 53 is operated at a minimum capacity in the cooling operation mode; and the compressor 53 is stopped to prohibit the heating operation mode under a condition in which the evaporation temperature of the refrigerant circuit 50 is lower than a dew-point temperature of the room air in a state where the compressor 53 is operated at a minimum capacity in the heating operation mode.

According to this eighth aspect of the present invention, under the condition in which while the compressor 53 is operated at a minimum capacity in the cooling operation mode, the evaporation temperature of the refrigerant circuit 50 is lower than the dew-point temperature of the outdoor air, the compressor 53 is stopped because there is a possibility that the interior of the room will be made too cool and that drain water will be produced. Also under the condition in which the compressor 53 is operated at a minimum capacity in the heating operation mode but the evaporation temperature of the refrigerant circuit 50 is lower than the dew-point temperature of the room air, the compressor 53 is stopped because there is a possibility that drain water will be produced.

A ninth aspect of the present invention is characterized in that in the fifth aspect of the present invention, the control means 70 is constructed so as to perform an ventilating operation mode under a condition in which the cooling operation mode and the heating operation mode are not set, the ventilating operation mode being a first ventilating operation mode performed while the air flowing state is fixed in a state where the refrigerant circuit 50 is stopped.

According to this ninth aspect of the present invention, when it is determined that the outside air humidity is between the upper limit and the lower limit of the preset humidity and that neither a condition in which the room temperature is lower than the outdoor temperature and is higher than the set temperature nor a condition in which the room temperature is higher than the outdoor temperature and is lower than the set temperature is satisfied, the first ventilating operation mode is selected. In this case, the outside air humidity is neither too high nor too low and hence the first ventilating operation mode for performing only ventilation simply is performed.

A tenth aspect of the present invention is characterized in that in the third aspect of the present invention, the control means 70 is constructed so as to perform an ventilating operation mode when the room air is closer to the set humidity than the outdoor air in a state satisfying a condition in which the dehumidifying operation mode and the humidifying operation mode are set, the ventilating operation mode being a second ventilating operation mode performed while the air flowing state is switched in a state where the refrigerant circuit 50 is stopped.

According to this tenth aspect of the present invention, when the dehumidifying operation mode can be performed because the outside air humidity is higher than the upper limit of the set humidity or the humidifying operation mode can be performed because the outside air humidity is lower than the lower limit of the set humidity, if the room air is closer to the set humidity than the outdoor air under a condition in which a forcible thermo-off is performed, the second ventilating operation mode is performed. The second ventilating operation mode is an operation mode which is performed while the air flowing state is switched alternately between the first operation and the second operation in a state where the refrigerant circuit 50 is stopped. The latent heat and sensible heat of air discharged from the inside of the room to the outside of the room are supplied to one of the adsorption heat exchangers 51, 52 and the latent heat and sensible heat are given to air to be supplied from the outside of the room to the inside of the room, so pseudo entire heat exchange ventilation is performed.

An eleventh aspect of the present invention is predicated on an air conditioning system including: an air passage 60 having a first passage 61 in which outdoor air flows to an inside of a room and a second passage 62 in which room air flows to an outside of the room; a heater 102, 153 that is disposed in the air passage 60 and heats air; a cooler 104, 153 that is disposed in the air passage 60 and cools air; and a first adsorbent member 111, 151, 152 and a second adsorbent member 112, 152, 151 that are disposed in the air passage 60 and can adsorb moisture in air and release moisture into the air.

In this air conditioning system, the air passage 60 is constructed so as to be able to switch between a first operating state, in which air flowing from the outside of the room to the inside of the room passes through the cooler 104, 153 and the first adsorbent member 111, 151, 152 or the second adsorbent member 112, 152, 151 and in which air flowing from the inside of the room to the outside of the room passes through the heater 102, 153 and the second adsorbent member 112, 152, 151 or the first adsorbent member 111, 151, 152, and a second operating state, in which the air flowing from the outside of the room to the inside of the room passes through the heater 102, 153 and the first adsorbent member 111, 151, 152 or the second adsorbent member 112, 152, 151 and in which the air flowing from the inside of the room to the outside of the room passes through the cooler 104, 153 and the second adsorbent member 112, 152, 151 or the first adsorbent member 111, 151, 152. Moreover, this air conditioning system is constructed so as to be able to perform a dehumidifying operation mode and a humidifying operation mode which are performed by switching a flow of air at specified intervals in each operating state; a cooling operation mode and a heating operation mode which are performed not by switching but by fixing the flow of air in each operating state; and a ventilating operation mode which is performed by flowing air through the air passage 60 in a state where the heater 102, 153 and the cooler 104, 153 are stopped.

According to the above-mentioned first to tenth aspects of the present invention, by the use of the adsorption heat exchangers 51, 52, the absorbent member and the cooler (evaporator) are integrated into one unit and the absorbent member and the heater (condenser) are integrated into one unit. However, according to this eleventh aspect of the present invention, various kinds of operation modes can be selected in the air conditioning system in which the first adsorbent member 111, 151, 152 and the second adsorbent member 112, 152, 151, and the cooler 104, 153 and the heater 102, 153 are disposed separately in the air passage 60.

For example, the dehumidifying operation mode can be performed by switching a first operation and a second operation alternately at specified intervals in the first operating state, the first operation passing the air flowing from the outside of the room to the inside of the room through the cooler 104, 153 and the first adsorbent member 111, 151, 152 and passing the air flowing from the inside of the room to the outside of the room through the heater 102, 153 and the second adsorbent member 112, 152, 151, the second operation passing the air flowing from the outside of the room to the inside of the room through the cooler 104, 153 and the second adsorbent member 112, 152, 151 and passing the air flowing from the inside of the room to the outside of the room through the heater 102, 153 and the first adsorbent member 111, 151, 152. Moreover, the humidifying operation mode can be performed by switching a first operation and a second operation alternately at specified intervals in the second operating state, the first operation passing the air flowing from the outside of the room to the inside of the room through the heater 102, 153 and the first adsorbent member 111, 151, 152 and passing the air flowing from the inside of the room to the outside of the room through the cooler 104, 153 and the second adsorbent member 112, 152, 151, the second operation passing the air flowing from the outside of the room to the inside of the room through the heater 102, 153 and the second adsorbent member 112, 152, 151 and passing the air flowing from the inside of the room to the outside of the room through the cooler 104, 153 and the first adsorbent member 111, 151, 152.

The cooling operation mode, just as with the first invention, can be performed by selecting either the first operation or the second operation in the dehumidifying operation mode and by performing the selected operation continuously. Moreover, the heating operation mode, just as with the first invention, can be performed by selecting either the first operation or the second operation in the humidifying operation mode and by performing the selected operation continuously. The ventilating operation mode can be performed by flowing air through the first passage 61 and the second passage 62 in a state where the heater 102, 153 and the cooler 104, 153 are stopped.

A twelfth aspect of the present invention is characterized in that in the eleventh aspect of the present invention, the ventilating operation mode is constructed of: a first ventilating operation mode performed while the heater 102, 153 and the cooler 104, 153 are stopped and the flow of air is fixed in each operating state; and a second ventilating operation mode performed while the heater 102, 153 and the cooler 104, 153 are stopped and the flow of air is switched in each operating state.

According to this twelfth aspect of the present invention, ventilation can be simply performed by performing the first ventilating operation mode and entire heat exchange ventilation can be performed in a pseudo manner by performing the second ventilating operation mode.

A thirteenth aspect of the present invention is characterized in that: the eleventh or the twelfth aspect of the present invention includes a heating medium circuit 100 in which a heating medium flows; the heater is constructed of a heat radiation side heat exchanger 102 in the heating medium circuit 100; and the cooler is constructed of a heat absorption side heat exchanger 104 in the heating medium circuit 100.

According to the thirteenth aspect of the present invention, the adsorbent can be heated by the heat radiation side heat exchanger 102 of the heating medium circuit 100 and the adsorbent can be cooled by heat absorption side heat exchanger 104 of the heating medium circuit 100.

A fourteenth aspect of the present invention is characterized in that: in the thirteenth aspect of the present invention, the heating medium circuit 100 is constructed of a refrigerant circuit 100 for performing a vapor compression type refrigeration cycle by circulating refrigerant; the heater is constructed of the condenser 102 of the refrigerant circuit 100; and the cooler is constructed of an evaporator 104 of the refrigerant circuit 100.

According to this fourteenth aspect of the present invention, the adsorbent can be heated by the condenser 102 of the refrigerant circuit 100 and the adsorbent can be cooled by the evaporator 104 of the refrigerant circuit 100.

A fifteenth aspect of the present invention is characterized in that: the eleventh or twelfth aspect of the present invention includes a Peltier effect device 153 having a first surface and a second surface switched to a heat radiation side and a heat absorption side by switching a polarity of an applied direct current source between plus and minus; the heater is constructed of the heat radiation side of the Peltier effect device 153; and the cooler is constructed of the heat absorption side of the Peltier effect device 153.

According to this fifteenth aspect of the present invention, the adsorbent can be heated by air passing through the heat radiation side of the Peltier effect device 153 and the adsorbent can be cooled by air passing through the heat absorption side of the Peltier effect device 153.

A sixteenth aspect of the present invention is characterized in that: in the fifteenth aspect of the present invention, an adsorbent is supported on the first surface and the second surface of the Peltier effect device 153; the first adsorption member 151, 152 is constructed of the first surface of the Peltier effect device 153; and the second adsorption member 152, 151 is constructed of the second surface of the Peltier effect device 153. Here, as a method for supporting the adsorbent on the surfaces of the Peltier effect device can be used a method for supporting the adsorbent directly on the surfaces of the Peltier effect device 153 and a method for fixing parts such as heat exchange fins in contact with the surfaces of the Peltier effect device 153 and for supporting the adsorbent on the surfaces of the parts.

According to this sixteenth aspect of the present invention, the adsorbent can be heated directly by the surface of the heat radiation side of the Peltier effect device 153 and the adsorbent can be cooled directly by the surface of the heat absorption side of the Peltier effect device 153.

Effect of the Invention

According to the present invention, in an air conditioning system including: an air passage 60 having a first passage 61 in which outdoor air flows to the inside of a room and a second passage 62 in which room air flows to the outside of the room; a refrigerant circuit 50 for performing a vapor compression type refrigeration cycle; and an adsorbent capable of adsorbing moisture in air and releasing moisture into the air, the heat exchanger of the refrigerant circuit 50 is constructed of a first adsorption heat exchanger 51 and a second adsorption heat exchanger 52 on the surfaces of which an adsorbent is held, and the refrigerant circuit 50 is constructed so as to be able to switch between a first refrigerant flowing state and a second refrigerant flowing state, and the air passage 60 is constructed so as to be able to switch between a first air flowing state and a second air flowing state. Thus, the air conditioning system can perform: a dehumidifying operation mode and a humidifying operation mode which are performed by switching the refrigerant flowing state and the air flowing state at specified intervals; a cooling operation mode and a heating operation mode which are performed not by switching but by fixing the refrigerant flowing state and the air flowing state; and a ventilating operation mode which is performed by flowing air through the air passage 60 in a state where the refrigerant circuit 50 is stopped.

As described above, according to the present invention, the refrigerant circuit 50 has only two adsorption heat exchangers 51, 52 and the air passage 60 does not need to have a complicated construction, either. Thus, it is possible to prevent the construction of the air conditioning system from becoming complicated and to respond to a variety of operation modes only by appropriately selecting the refrigerant flowing state and the air flowing state.

According to the second aspect of the present invention, there is provided the control means 70 that determines an optimal operation mode on the basis of at least the state quantity of the room air and the state quantity of the outdoor air and sets an operation mode. Thus, the control means 70 determines which operation mode of the dehumidifying operation mode, the humidifying operation mode, the cooling operation mode, the heating operation mode, and the ventilating operation mode is required and can select an operation mode suitable for the states of the room air and the outdoor air automatically.

According to the third aspect of the present invention, when the outdoor air humidity is higher than the upper limit of the set humidity, the dehumidifying operation mode can be performed. At this time, even if the outdoor humidity is high, when the outside air temperature is low, the dehumidifying operation can make the room temperature too low, so in this case the dehumidifying operation mode may be not performed but the ventilating operation may be also performed. Moreover, when the outdoor humidity is lower than the lower limit of the set humidity, the humidifying operation mode can be performed. At this time, even if the outdoor humidity is low, when the outdoor temperature is high, the humidifying operation can make the room temperature too high, so in this case the humidifying operation mode may be not performed but the ventilating operation may be also performed.

According to the fourth aspect of the present invention, when the outside air humidity is between the upper limit and the lower limit of the set humidity, the cooling operation mode and the heating operation mode can be performed. Thus, depending on the condition, the cooling operation mode, the heating operation mode, or the ventilating operation mode can be selected. In other words, an optimal operation mode can be automatically selected.

According to the fifth aspect of the present invention, when the outdoor air humidity is between the upper limit and the lower limit of the preset humidity and the room temperature is lower than the outdoor temperature and the room temperature is higher than the set temperature, the cooling operation mode is selected. Moreover, when the outdoor air humidity is between the upper limit and the lower limit of the preset humidity and the room temperature is higher than the outdoor temperature and the room temperature is lower than the set temperature, the heating operation mode is selected. Thus, also in this case, an optimal operation can be automatically selected.

When the evaporation temperature of the refrigerant circuit 50 in the cooling operation mode is lower than the dew-point temperature of the outdoor air or when the evaporation temperature of the refrigerant circuit 50 in the heating operation mode is lower than the dew-point temperature of the room air, there is a possibility that the adsorption heat exchangers 51, 52 will produce drain water. On the other hand, according to the sixth aspect of the present invention, the evaporation temperature of the refrigerant circuit 50 in the cooling operation mode is set higher than the dew-point temperature of the outdoor air and the evaporation temperature of the refrigerant circuit 50 in the heating operation mode is set higher than the dew-point temperature of the room air, so it is possible to prevent the drain water from being produced. Thus, it is possible to prevent rust and fungus from being formed in the unit of the air conditioning system by drain water.

According to the seventh aspect of the present invention, even if the evaporation temperature of the refrigerant circuit 50 reaches a target value in the cooling operation mode and in the heating operations when a pressure difference between the high pressure and the low pressure, which is required in the refrigerant circuit 50, cannot be acquired (high pressure is not increased) because of the outside air condition, an appropriate operation according to a predetermined Mollier chart cannot be performed, so the compressor 53 is stopped. With this, a useless operation can be omitted. In this case, it suffices to stop the compressor 53 until a specified time passes and then to start the compressor 53 again.

According to the eighth aspect of the present invention, under a condition in which although the compressor 53 is operated at a minimum capacity in the cooling operation mode, the evaporation temperature of the refrigerant circuit 50 is lower than the dew-point temperature of the outdoor air, the compressor 53 is stopped to prohibit the cooling operation mode. Moreover, under a condition in which although the compressor 53 is operated at a minimum capacity in the heating operation mode, the evaporation temperature of the refrigerant circuit 50 is lower than the dew-point temperature of the room air, the compressor 53 is stopped to prohibit the heating operation mode. Thus, this can prevent a useless operation from being performed.

According to the ninth aspect of the present invention, when the outside air humidity is between the upper limit and the lower limit of the preset humidity and neither a condition that the room temperature is lower than the outdoor temperature and is higher than the set temperature nor a condition that the room temperature is higher than the outdoor temperature and is lower than the set temperature is satisfied, the first ventilating operation mode is selected. In this case, the outside air humidity is neither too high nor too low and hence the first ventilating operation mode for simply performing only the ventilating operation is performed. In other words, it suffices to operate a fan in the first passage 61 and the second passage 62 and hence the simplest operation can be performed.

According to the tenth aspect of the present invention, when the room air is closer to the set humidity than the outdoor air in a state satisfying a condition in which the dehumidifying operation mode and the humidifying operation mode are set, the second ventilating operation mode is performed. In other words, when the outside air humidity is out of the range of the set humidity, if the room air is closer to the set humidity than the outdoor air, neither the dehumidifying operation not the humidifying operation is performed but a pseudo entire heat exchange ventilating operation is performed. This can reduce power consumption caused by staring the refrigerant circuit 50.

According to the eleventh aspect of the present invention, in the air conditioning system in which the first adsorbent member 111, 151, 152 and the second adsorbent member 112, 152, 151, and the cooler 104, 153 and the heater 102, 153 are disposed separately in the air passage 60, it is possible to perform various kinds of operation modes of the dehumidifying operation mode, the humidifying operation mode, the cooling operation mode, the heating operation mode, and the ventilating operation mode and hence to respond to a variety of operation modes. Moreover, in the air conditioning system in which the first adsorbent member 111, 151, 152 and the second adsorbent member 112, 152, 151, and the cooler 104, 153 and the heater 102, 153 are disposed separately in the air passage 60, it is possible to perform the above-mentioned various kinds of operation modes only by switching or stopping the operation in the first operating state and the second operating state and hence it is not necessary to make the construction complicated, either.

According to the twelfth aspect of the present invention, only ventilation can be simply performed by performing the first ventilating operation mode and entire heat exchange ventilation can be performed in a pseudo manner by performing the second ventilating operation mode. Thus, it is possible to respond to a more variety of operation modes.

According to the thirteenth aspect of the present invention, the heating medium circuit 100 is used in which a heating medium such as cooling or warming water or refrigerant flows; the heater is constructed of the heat radiation side heat exchanger 102 in the heating medium circuit 100; and the cooler is constructed of a heat absorption side heat exchanger 104 in the heating medium circuit 100. Thus, the adsorbent can be heated by the heat radiation side heat exchanger 102 in the heating medium circuit 100 and the adsorbent can be cooled by heat absorption side heat exchanger 104 in the heating medium circuit 100.

According to the fourteenth aspect of the present invention, the refrigerant circuit 100 for performing a vapor compression type refrigeration cycle by circulating refrigerant is used; the heater is constructed of the condenser 102 of the refrigerant circuit 100; and the cooler is constructed of the evaporator 104 of the refrigerant circuit 100. Thus, the adsorbent can be heated by the condenser 102 of the refrigerant circuit 100 and the adsorbent can be cooled by the evaporator 104 of the refrigerant circuit 100.

According to the fifteenth aspect of the present invention, the Peltier effect device 153 is used in which a first surface and a second surface are switched to a heat radiation side and a heat absorption side by switching a polarity of an applied direct current source between plus and minus; the heater is constructed of the heat radiation side of the Peltier effect device 153; and the cooler is constructed of the heat absorption side of the Peltier effect device 153. Thus, the adsorbent can be heated by air passing through the heat radiation side of the Peltier effect device 153 and the adsorbent can be cooled by air passing through the heat absorption side of the Peltier effect device 153.

According to the sixteenth aspect of the present invention, an adsorbent is supported on the first surface and the second surfaces of the Peltier effect device 153; the first adsorption member 151, 152 is constructed of the first surface of the Peltier effect device 153; and the second adsorption member 152, 151 is constructed of the second surface of the Peltier effect device 153. Thus, the adsorbent can be heated directly by the surface of the heat radiation side of the Peltier effect device 153 and the adsorbent can be cooled directly by the surface of the heat adsorption side of the Peltier effect device 153.

BRIEF DESCRIPTION OF THE DRAWINGS

FIG. 2 show schematic construction of the air conditioner of the embodiment 1.

FIG. 3 are piping system diagrams showing the construction of a refrigerant circuit of the embodiment 1.

FIG. 5 are schematic construction diagrams of the air conditioner that show the flow of air during the first operation of a dehumidifying operation mode.

FIG. 6 are schematic construction diagrams of the air conditioner that show the flow of air during the second operation of the dehumidifying operation mode.

FIG. 7 are schematic construction diagrams of the air conditioner that show the flow of air during the first operation of a humidifying operation mode.

FIG. 8 are schematic construction diagrams of the air conditioner that show the flow of air during the second operation of the humidifying operation mode.

FIG. 10 are schematic construction diagrams of the air conditioner in a first modification of the other embodiment.

DESCRIPTION OF THE REFERENCE CHARACTERS

Figure 1:
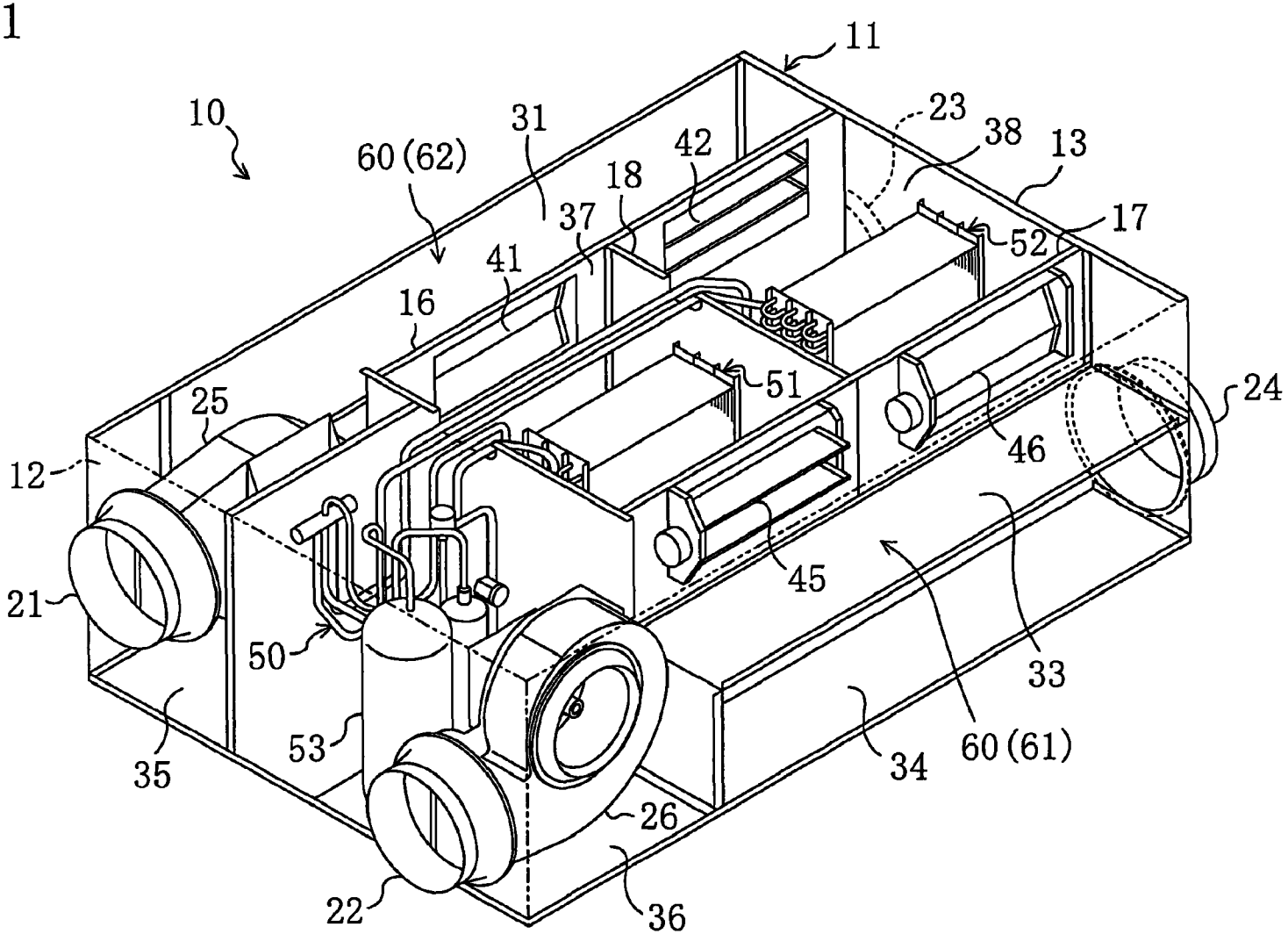
FIG. 1 is a perspective view showing the construction of an air conditioner constructing an air conditioning system of an embodiment 1.

10 air conditioner (air conditioning system)
50 refrigerant circuit
51 first adsorption heat exchanger
52 second adsorption heat exchanger
53 compressor
60 air passage
61 first passage
62 second passage
70 control means
100 refrigerant circuit (heating medium circuit)
102 condenser (heat radiation side heat exchanger, heater)
104 evaporator (heat absorption side heat exchanger, cooler)
111 first adsorbent member
112 second adsorbent member
151 first adsorbent member (second adsorbent member)
152 second adsorbent member (first adsorbent member)
153 Peltier effect device (heater, cooler)

BEST MODE FOR CARRYING OUT THE INVENTION

Embodiments of the present invention will hereinafter be described in detail with reference to the drawings.

Embodiment 1 of the Invention

An embodiment 1 of the present invention will be described. An air conditioning system of this embodiment is constructed of an air conditioner 10 provided with: an air passage 60 having a first passage 61 through which outdoor air flows into a room and a second passage 62 through which room air flows outside the room; a refrigerant circuit 50 performing a vapor compression type refrigeration cycle; and adsorbents (adsorbent members 111, 112) capable of adsorbing moisture in air and releasing moisture into the air. This air conditioning system is a ventilation type air conditioning system. While this air conditioning system is operated, the system takes outdoor air (OA) and supplies the outdoor air into the room and at the same time takes room air (RA) and discharges the room air outside the room.

<General Construction of Air Conditioner>

Figure 2A:
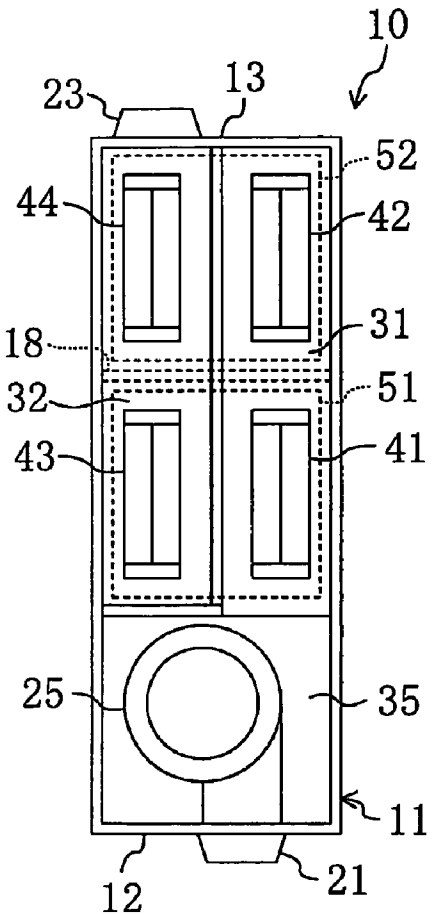
FIG. 2A is a construction diagram when viewed from the left side.
Figure 2B:
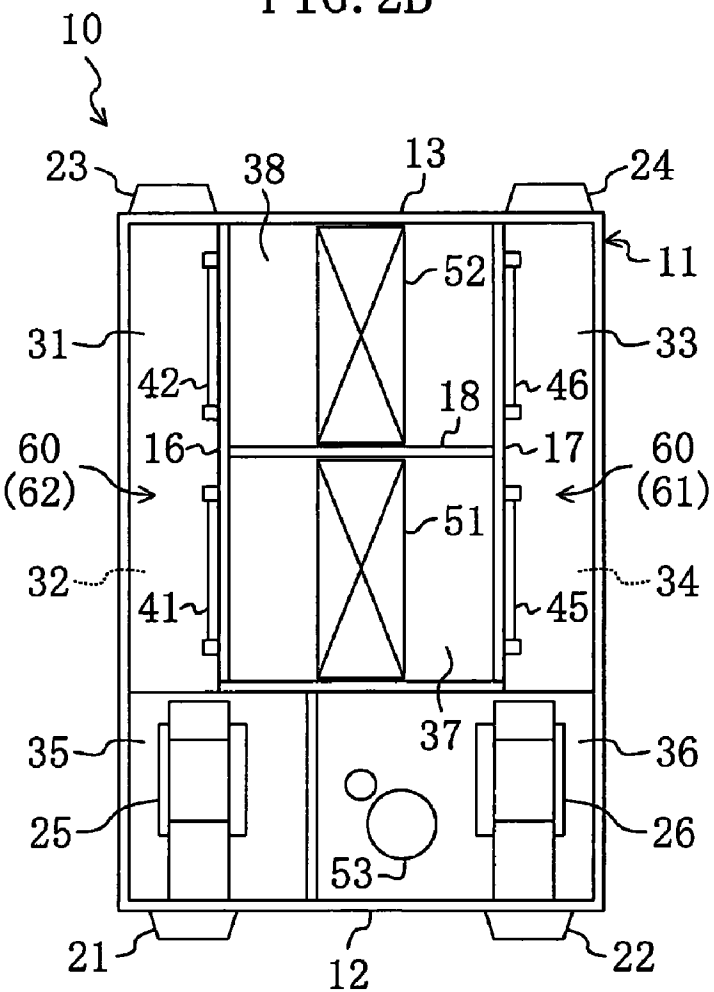
FIG. 2B is a construction diagram when viewed from the top side.
Figure 2C:
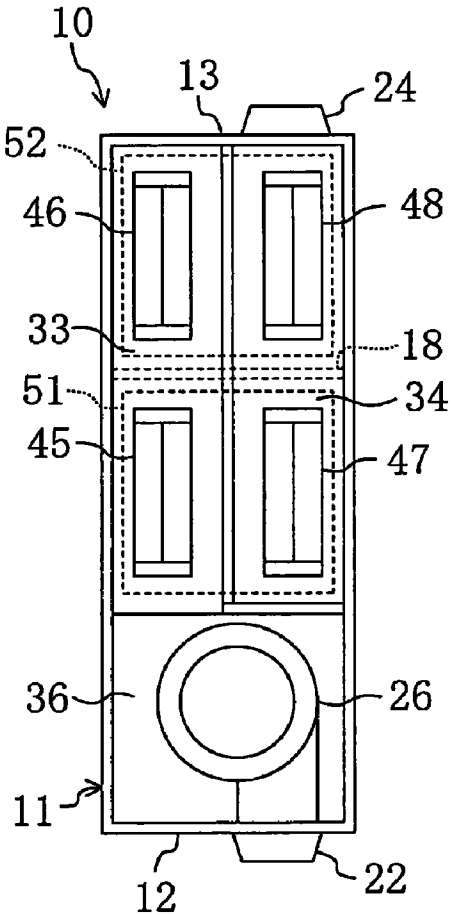
FIG. 2C is a construction diagram when viewed from the right side.

The above-mentioned air conditioner 10 will be described with reference to FIG. 1 and FIG. 2. In this regard, the words of "upper", "lower", "left", "right", "front", "rear", "front side", and "back side" used in this description mean directions when the above-mentioned air conditioner 10 is viewed from the front side, except where specifically noted.

The above-mentioned air conditioner 10 has a casing 11. The casing 11 has the refrigerant circuit 50 housed therein. This refrigerant circuit 50 has a first adsorption heat exchanger 51, a second adsorption heat exchanger 52, a compressor 53, a four-way switching valve 54, and an electrically operated expansion valve 55 connected thereto. The refrigerant circuit 50 will be later described in detail.

The casing 11 is formed in the shape of a flat rectangular box having a comparatively low height. In this casing 11, a front panel 12 is erected on the left front side in FIG. 1 and a rear panel 13 is erected on the right back side in FIG. 1 and a direction from the left front side to the right back side in FIG. 1 is a longitudinal direction.

In the front panel 12 of the casing 11, an exhaust port 21 opens at a position closer to the left and an air supply port 22 opens at a position closer to the right, respectively. In the rear panel 13 of the casing 11, an outside air suction port 23 opens at a position closer to the left and an inside air suction port 24 opens at a position closer to the right, respectively.

The inside space of the casing 11 is partitioned into a portion on the front panel 12 side and a portion on the rear panel 13 side.

The space on the front panel 12 side in the casing 11 is partitioned into two left and right spaces. Of these left and right partitioned spaces, a left space constructs an exhaust fan chamber 35 and a right space constructs an air supply fan chamber 36, respectively. The exhaust fan chamber 35 connects with an outdoor space through the exhaust port 21. This exhaust fan chamber 35 has an exhaust fan 25 housed therein and a blowoff port of the exhaust fan 25 is connected with the exhaust port 21. On the other hand, the air supply fan chamber 36 connects with an indoor space through the air supply port 22. This air supply fan chamber 36 has an air supply fan 26 housed therein and a blowoff port of the air supply fan 26 is connected with the air supply port 22. Moreover, the air supply fan chamber 36 has a compressor 53 also housed therein.

On the other hand, a space on the rear panel 13 side in the casing 11 is partitioned into three left and right spaces by a first partition plate 16 and a second partition plate 17 which are erected in the casing 11. These partition plates 16, 17 are extended along a longitudinal direction of the casing 11 from the rear panel 13. The first partition plate 16 is disposed closer to the right plate of the casing 11 and the second partition plate 17 is disposed closer to the left plate of the casing 11.

In the casing 11, a space on the left side of the first partition plate 16 is partitioned into two upper and lower spaces, and the upper space constructs an exhaust side channel 31 and the lower space constructs an outside air side channel 32, respectively. The exhaust side channel 31 connects with the exhaust fan chamber 35. The outside air side channel 32 connects with the outdoor space through the outside air suction port 23. On the other hand, a space on the right side of the first partition plate 16 is partitioned into two upper and lower spaces, and the upper space constructs an air supply side channel 33 and the lower space constructs an inside air side channel 34, respectively. The air supply side channel 33 connects with the air supply fan chamber 36. The inside air side channel 34 connects with the interior of the room through the inside air suction port 24.

A space between the first partition plate 16 and the second partition plate 17 is further partitioned into two front and rear spaces by a central partition plate 18. A space on the front side of the central partition plate 18 constructs a first heat exchanger chamber 37 and a space on the rear side of the central partition plate 18 constructs a second heat exchanger chamber 38. The first heat exchanger chamber 37 has a first adsorption heat exchanger 51 housed therein and the second heat exchanger chamber 38 has a second adsorption heat exchanger 52 housed therein. These two adsorption heat exchangers 51, 52 are disposed so as to cross the heat exchanger chambers 37, 38, in which the adsorption heat exchangers 51, 52 are respectively housed, in a front and rear direction.

The first partition plate 16 has four opening/closing dampers 41 to 44. Specifically, in the first partition plate 16, a first damper 41 is fixed to an upper portion on the front side, a second damper 42 is fixed to an upper portion on the rear side, a third damper 43 is fixed to a lower portion on the front side, and a fourth damper 44 is fixed to the lower portion on the rear side. When the first damper 41 is opened, the exhaust side channel 31 is connected with the first heat exchanger chamber 37. When the second damper 42 is opened, the exhaust side channel 31 is connected with the second heat exchanger chamber 38. When the third damper 43 is opened, the outside air side channel 32 is connected with the first heat exchanger chamber 37. When the fourth damper 44 is opened, the outside air side channel 32 is connected with the second heat exchanger chamber 38.

The second partition plate 17 has four opening/closing dampers 45 to 48. Specifically, in the second partition plate 17, a fifth damper 45 is fixed to an upper portion on the front side, a sixth damper 46 is fixed to an upper portion on the rear side, a seventh damper 47 is fixed to a lower portion on the front side, and an eighth damper 48 is fixed to the lower portion on the rear side. When the fifth damper 45 is opened, the air supply side channel 33 is connected with the first heat exchanger chamber 37. When the sixth damper 46 is opened, the air supply side channel 33 is connected with the second heat exchanger chamber 38. When the seventh damper 47 is opened, the inside air side channel 34 is connected with the first heat exchanger chamber 37. When the eighth damper 48 is opened, the inside air side channel 34 is connected with the second heat exchanger chamber 38.

An air passage 60 disposed in the casing 11 of this air conditioner 10 has a first passage 61 through which the outdoor air flows into the room and a second passage 62 through which the room air flows outside the room. An air path in the first passage 61 and an air path in the second passage 62 are switched from each other. Specifically, the air passage 60 is constructed so as to be switched between a first air flowing state, in which air flowing from the outside of the room to the inside of the room flows through the first adsorption heat exchanger 51 and in which air flowing from the inside of the room to the outside of the room flows through the second heat exchanger 52, and a second air flowing state, in which air flowing from the outside of the room to the inside of the room flows through the second adsorption heat exchanger 52 and in which air flowing from the inside of the room to the outside of the room flows through the first heat exchanger 51.

<Construction of Refrigerant Circuit>

The above-mentioned refrigerant circuit 50 will be described with reference to FIG. 3.

The above-mentioned refrigerant circuit 50 is a closed circuit having the first adsorption heat exchanger 51, the second adsorption heat exchanger 52, the compressor 53, the four-way switching valve 54, and the electrically operated expansion valve 55. This refrigerant circuit 50 circulates packed refrigerant to perform a vapor compression type refrigeration cycle. Moreover, the compressor 53 is a variable displacement compressor capable of variably controlling an operating capacity by controlling an operating frequency by inverter control.

In the refrigerant circuit 50, the compressor 53 has its discharge side connected to the first port of the four-way switching valve 54 and has its suction side connected to the second port of the four-way switching valve 54, respectively. One end of the first adsorption heat exchanger 51 is connected to the third port of the four-way switching valve 54. The other end of the first adsorption heat exchanger 51 is connected to one end of the second adsorption heat exchanger 52 via the electrically operated expansion valve 55. The other end of the second adsorption heat exchanger 52 is connected to the fourth port of the four-way switching valve 54.

The four-way switching valve 54 can switch between a first state (state shown in FIG. 1A) in which the first port connects with the third port and in which the second port connects with the fourth port and a second state (state shown in FIG. 1B) in which the first port connects with the fourth port and in which the second port connects with the third port.

Thus, the refrigerant circuit 50 is constructed so as to switch between a first refrigerant flowing state in which the first adsorption heat exchanger 51 acts as an evaporator and in which the second adsorption heat exchanger 52 acts as a condenser and a second refrigerant flowing state in which the second adsorption heat exchanger 52 acts as an evaporator and in which the first adsorption heat exchanger 51 acts as a condenser.

Figure 4:
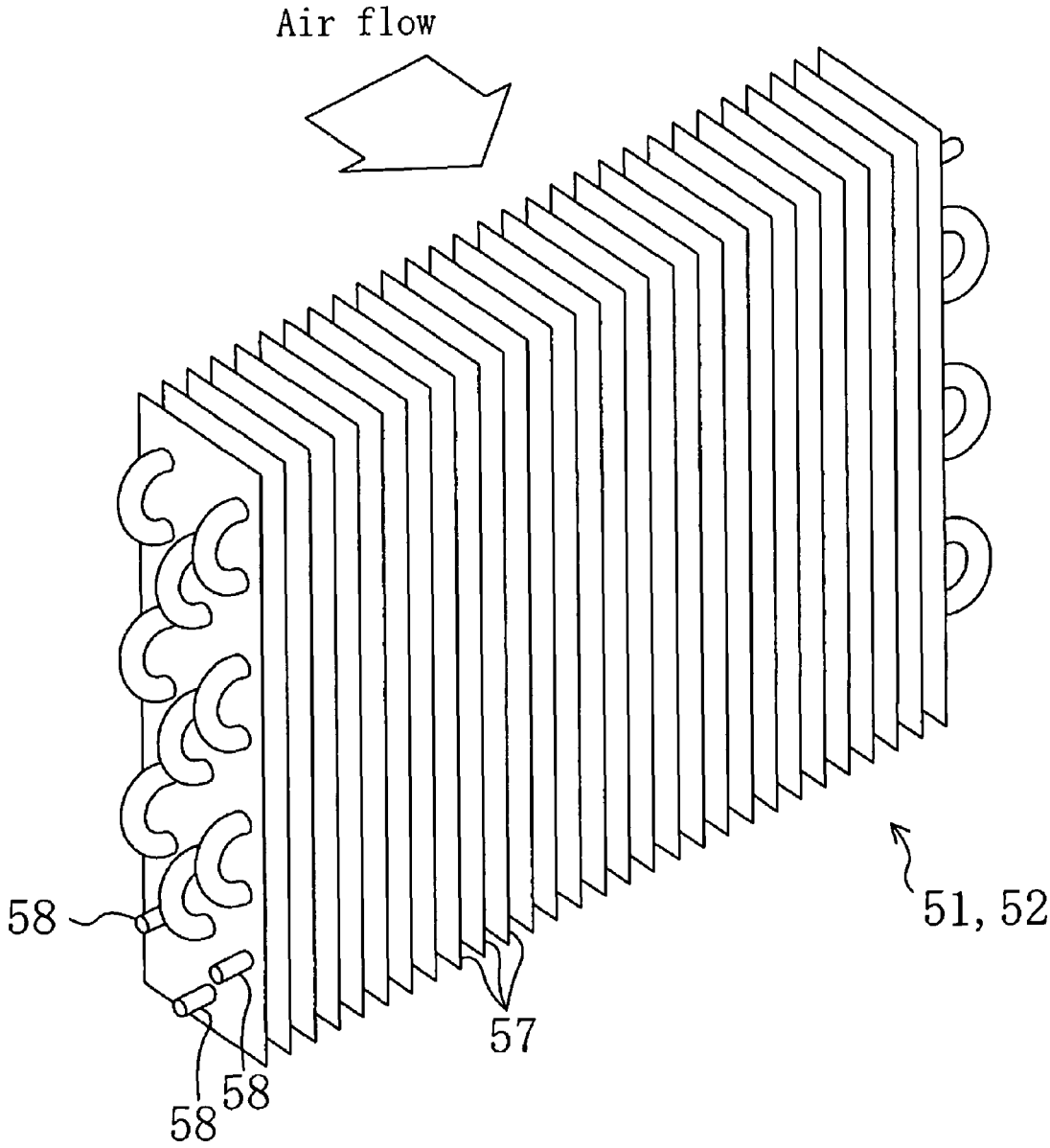
FIG. 4 is a schematic perspective view of an adsorption heat exchanger.

As shown in FIG. 4, each of the first adsorption heat exchanger 51 and the second adsorption heat exchanger 52 is constructed of a cross-fin type fin-and-tube heat exchanger. Each of these adsorption heat exchangers 51 and 52 is provided with heating tubes 58 made of copper and fins 57 made of aluminum. The plural fins 57 disposed in the adsorption heat exchangers 51 and 52 are formed respectively in the shape of a rectangular plate and are disposed at specified spacings. Moreover, the heating tubes 58 are disposed so as to pass through the respective fins 57.

The respective adsorption heat exchangers 51 and 52 have an adsorbent supported on the surfaces of the respective fins 57 and air passing between the fins 57 is brought into contact with the adsorbent supported on the fins 57. An adsorbent capable of adsorbing moisture in the air and releasing moisture into the air such as zeolite, silica gel, activated carbon, and organic polymeric material having a hydrophilic group is used as this adsorbent.

-Operation-

The air conditioner 10 of this embodiment is constructed so as to be able to perform six kinds of operation modes of a dehumidifying operation mode, a humidifying operation mode, a cooling operation mode, a heating operation mode, a first ventilating operation mode, and a second ventilating operation mode. In this air conditioner 10, during the respective operation modes, taken-in outdoor air (OA) is supplied as supply air (SA) into the room and at the same time taken-in room air (RA) is discharged as exhaust air (EA) to the outside of the room.

<Dehumidifying Operation Mode>

In the air conditioner 10 during the dehumidifying operation mode, the air supply fan 26 and the exhaust fan 25 are operated. When the air supply fan 26 is operated, the outdoor air is taken as first air into the casing 11 through the outside air suction port 23. When the exhaust fan 25 is operated, the room air is taken as second air into the casing 11 through the inside air suction port 24. Moreover, in the air conditioner 10 during the dehumidifying operation mode, the first operation and the second operation are performed alternately at specified intervals (for example, at intervals of three minutes).

The first operation at the time of the dehumidifying operation mode will be described. At this time, the air passage 60 is brought into the second air flowing state and the refrigerant circuit 50 is brought into the second refrigerant flowing state.

Figure 3B:
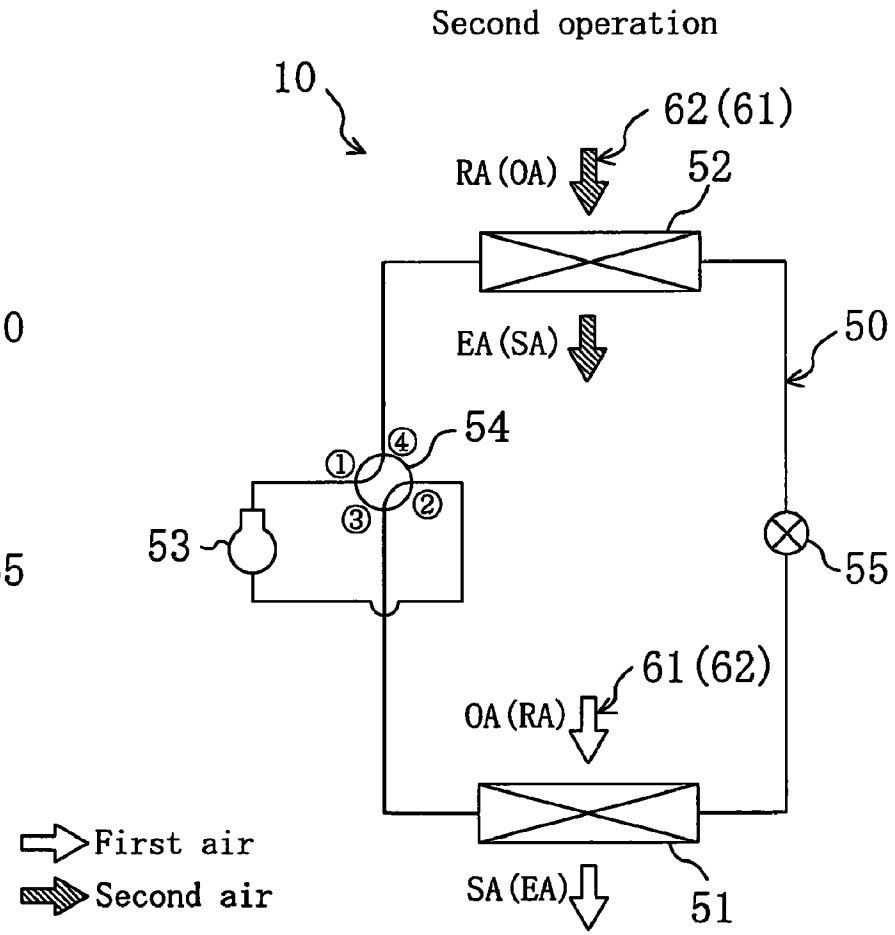
FIG. 3A is a diagram showing an operation during a first operation and FIG. 3B is a diagram showing an operation during a second operation.
Figure 3A:
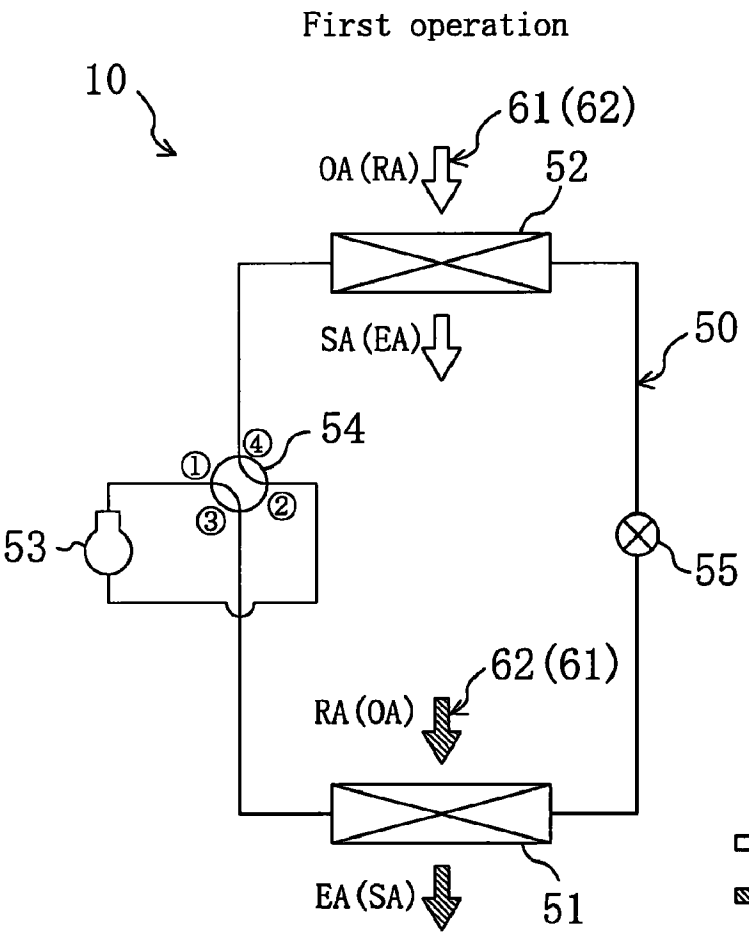

In the refrigerant circuit 50 during this first operation, as shown in FIG. 3A, the four-way switching valve 54 is set to a first state. In the refrigerant circuit 50 in this state, the refrigerant is circulated and the refrigeration cycle is performed. At this time, in the refrigerant circuit 50, the refrigerant discharged from the compressor 53 passes through the first adsorption heat exchanger 51, the electrically operated expansion valve 55, and the second adsorption heat exchanger 52 in this order and the first adsorption heat exchanger 51 acts as the condenser and the second adsorption heat exchanger 52 acts as the evaporator.

Figures 5A, 5B, 5C:
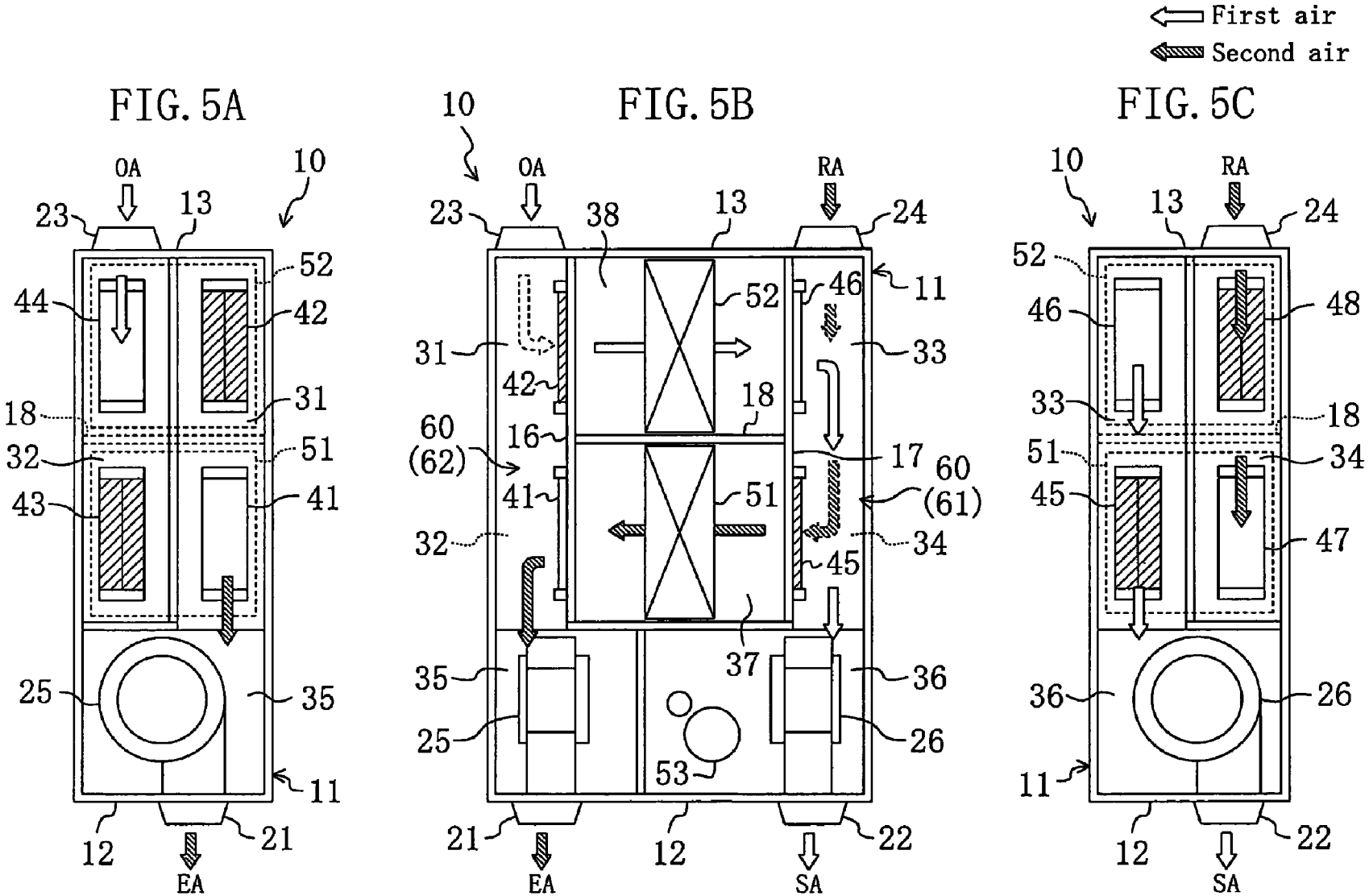
FIG. 5A is a construction diagram when viewed from the left side.
FIG. 5B is a construction diagram when viewed from the top side.
FIG. 5C is a construction diagram when viewed from the right side.

As shown in FIG. 5, during this first operation, only the first damper 41, the fourth damper 44, the sixth damper 46, and the seventh damper 47 are brought into an open state and the remaining dampers 42, 43, 45, and 48 are brought into a closed state.

The first air flowing into the outside air side passage 32 through the outside air suction port 23 passes through the fourth damper 44 and flows into the second heat exchanger chamber 38 and then passes through the second adsorption heat exchanger 52. In the second adsorption heat exchanger 52, moisture in the first air is adsorbed by the adsorbent and adsorption heat produced at this time is absorbed by the refrigerant. The first air dehumidified by the second adsorption heat exchanger 52 passes through the sixth damper 46 and flows into the air supply side passage 33 and then passes through the air supply fan chamber 36 and then passes through the air supply port 22 and then is supplied into the room.

On the other hand, the second air flowing into the inside air side passage 34 through the inside air suction port 24 passes through the seventh damper 47 and flows into the first heat exchanger chamber 37 and then passes through the first adsorption heat exchanger 51. In the first adsorption heat exchanger 51, moisture is desorbed from the adsorbent heated by the refrigerant. This desorbed moisture is supplied to the second air. The second air humidified by the first adsorption heat exchanger 51 passes through the first damper 41 and flows into the exhaust side passage 31 and then passes through the exhaust fan chamber 35 and then passes through the exhaust port 21 and then is discharged to the outside of the room.

The second operation at the time of the dehumidifying operation mode will be described. At this time, the air passage 60 is brought into the first air flowing state and the refrigerant circuit 50 is brought into the first refrigerant flowing state.

In the refrigerant circuit 50 during this second operation, as shown in FIG. 3B, the four-way switching valve 54 is set to a second state. In the refrigerant circuit 50 in this state, the refrigerant is circulated and the refrigeration cycle is performed. At this time, in the refrigerant circuit 50, the refrigerant discharged from the compressor 53 passes through the second adsorption heat exchanger 52, the electrically operated expansion valve 55, and the first adsorption heat exchanger 51 in this order and the second adsorption heat exchanger 52 acts as the condenser and the first adsorption heat exchanger 51 acts as the evaporator.

Figures 6A, 6B, 6C:
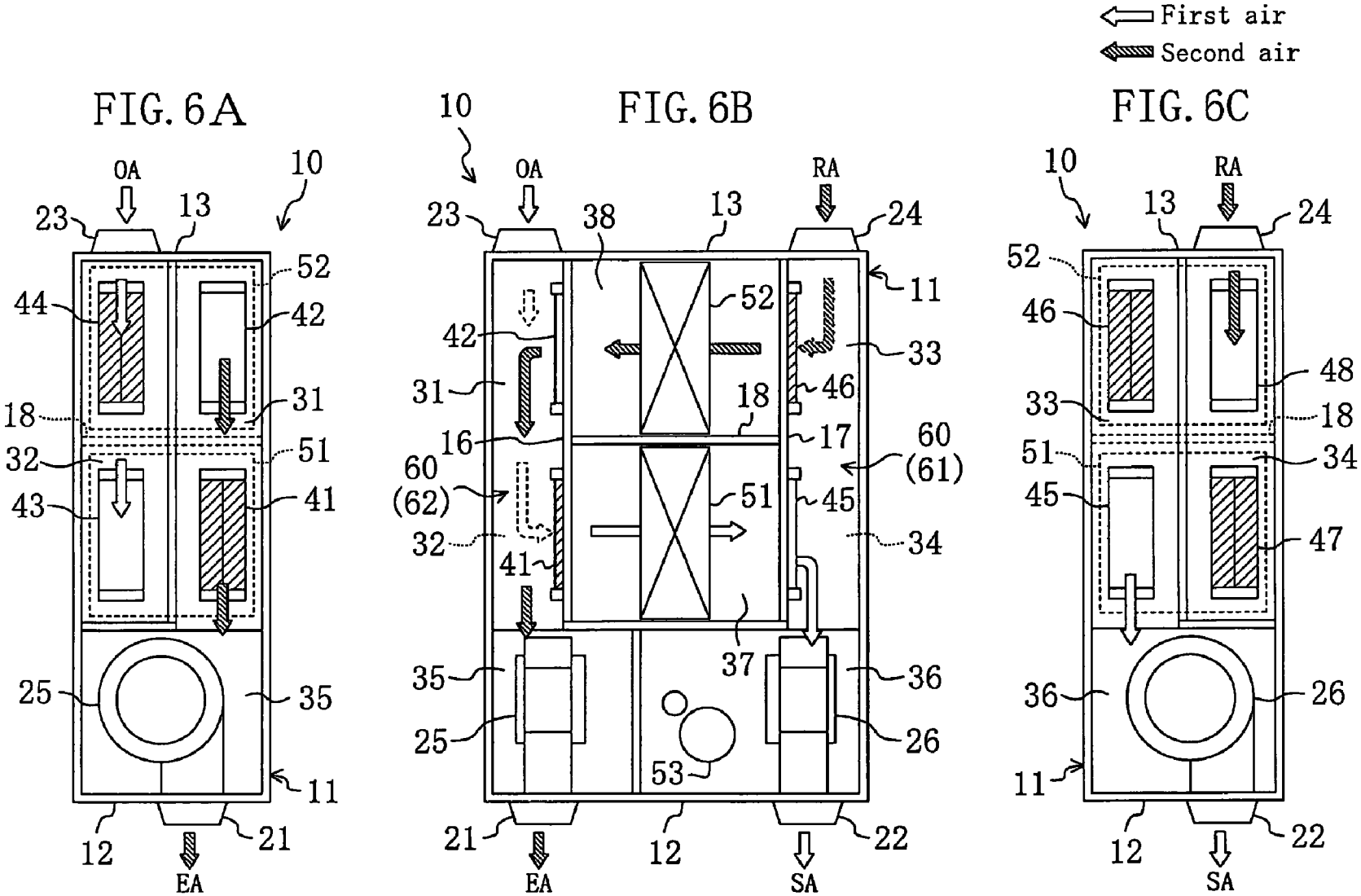
FIG. 6A is a construction diagram when viewed from the left side.
FIG. 6B is a construction diagram when viewed from the top side.
FIG. 6C is a construction diagram when viewed from the right, side.

As shown in FIG. 6, during this second operation, only the second damper 42, the third damper 43, the fifth damper 45, and the eighth damper 48 are brought into an open state and the remaining dampers 41, 44, 46, and 47 are brought into a closed state.

The first air flowing into the outside air side passage 32 through the outside air suction port 23 passes through the third damper 43 and flows into the first heat exchanger chamber 37 and then passes through the first adsorption heat exchanger 51. In the first adsorption heat exchanger 51, moisture in the first air is adsorbed by the adsorbent and adsorption heat produced at this time is absorbed by the refrigerant. The first air dehumidified by the first adsorption heat exchanger 51 passes through the fifth damper 45 and flows into the air supply side passage 33 and then passes through the air supply fan chamber 36 and then passes through the air supply port 22 and then is supplied into the room.

On the other hand, the second air flowing into the inside air side passage 34 through the inside air suction port 24 passes through the eighth damper 48 and flows into the second heat exchanger chamber 38 and then passes through the second adsorption heat exchanger 52. In the second adsorption heat exchanger 52, moisture is desorbed from the adsorbent heated by the refrigerant. This desorbed moisture is supplied to the second air. The second air humidified by the second adsorption heat exchanger 52 passes through the second damper 42 and flows into the exhaust side passage 31 and then passes through the exhaust fan chamber 35 and then passes through the exhaust port 21 and then is discharged to the outside of the room.

During the dehumidifying operation mode, as described above, the first operation and the second operation are performed alternately at specified intervals (for example, at intervals of three minutes). In other words, in a period during which the moisture in the first air is adsorbed by the adsorbent in the second adsorption heat exchanger 52 is performed the first operation in which the adsorbent in the first adsorption heat exchanger 51 is regenerated by the second air, whereas in a period during which the moisture in the first air is adsorbed by the adsorbent in the first adsorption heat exchanger 51 is performed the second operation in which the adsorbent in the second adsorption heat exchanger 52 is regenerated by the second air. By performing these first and second operations alternately repeatedly, the interior of the room is continuously dehumidified.

<Humidifying Operation Mode>

In the air conditioner 10 during the humidifying operation mode, the air supply fan 26 and the exhaust fan 25 are operated. When the air supply fan 26 is operated, the outdoor air is taken as second air into the casing 11 through the outside air suction port 23. When the exhaust fan 25 is operated, the room air is taken as first air into the casing 11 through the inside air suction port 24. Moreover, in the air conditioner 10 during the humidifying operation mode, the first operation and the second operation are performed alternately at specified intervals (for example, at intervals of three minutes).

The first operation at the time of the humidifying operation mode will be described. At this time, the air passage 60 is brought into the first air flowing state and the refrigerant circuit 50 is brought into the second refrigerant flowing state.

In the refrigerant circuit 50 during this first operation, as shown in FIG. 3A, the four-way switching valve 54 is set to the first state. In the refrigerant circuit 50 in this state, just as with the case during the first operation in the dehumidifying operation mode, the first adsorption heat exchanger 51 acts as the condenser and the second adsorption heat exchanger 52 acts as the evaporator.

Figures 7A, 7B, 7C:
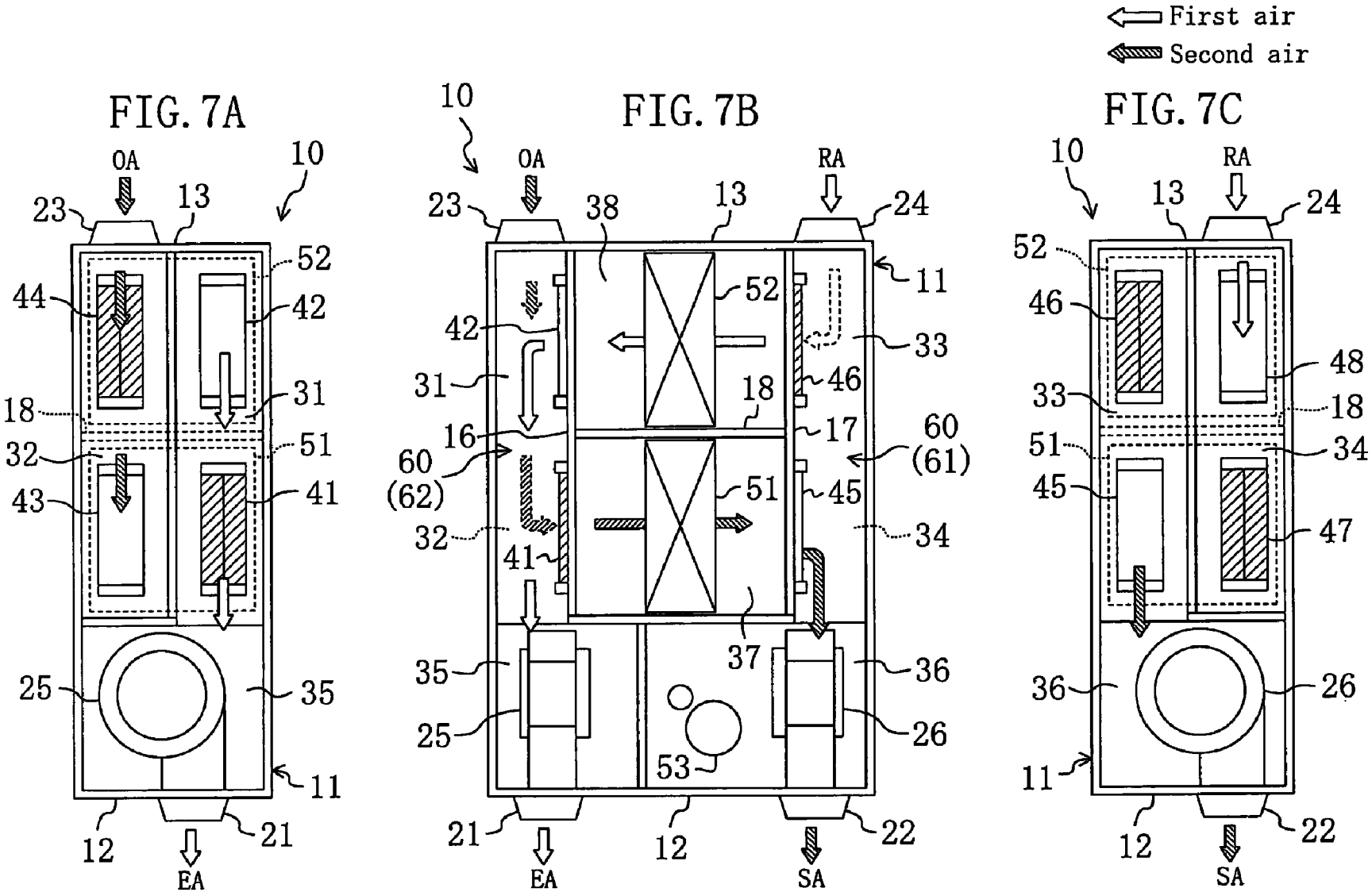
FIG. 7A is a construction diagram when viewed from the left side.
FIG. 7B is a construction diagram when viewed from the top side.
FIG. 7C is a construction diagram when viewed from the right side.

As shown in FIG. 7, during this first operation, only the second damper 42, the third damper 43, the fifth damper 45, and the eighth damper 48 are brought into an open state and the remaining dampers 41, 44, 46, and 47 are brought into a closed state.

The first air flowing into the inside air side passage 34 through the inside air suction port 24 passes through the eighth damper 48 and flows into the second heat exchanger chamber 38 and then passes through the second adsorption heat exchanger 52. In the second adsorption heat exchanger 52, moisture in the first, air is adsorbed by the adsorbent and adsorption heat produced at this time is absorbed by the refrigerant. The first air dehumidified by the second adsorption heat exchanger 52 passes through the second damper 42 and flows into the exhaust side passage 31 and then passes through the exhaust fan chamber 35 and then passes through the exhaust port 21 and then is discharged to the outside of the room.

On the other hand, the second air flowing into the outside air side passage 32 through the outside air suction port 23 passes through the third damper 43 and flows into the first heat exchanger chamber 37 and then passes through the first adsorption heat exchanger 51. In the first adsorption heat exchanger 51, moisture is desorbed from the adsorbent heated by the refrigerant. This desorbed moisture is supplied to the second air. The second air humidified by the first adsorption heat exchanger 51 passes through the fifth damper 45 and flows into the air supply side passage 33 and then passes through the air supply fan chamber 36 and then passes through the air supply port 22 and then is supplied into the room.

The second operation at the time of the humidifying operation mode will be described. At this time, the air passage 60 is brought into the second air flowing state and the refrigerant circuit 50 is brought into the first refrigerant flowing state.

In the refrigerant circuit 50 during this second operation, as shown in FIG. 3B, the four-way switching valve 54 is set to a second state. In the refrigerant circuit 50 in this state, just as with the case during the second operation mode of the dehumidifying operation mode, the second adsorption heat exchanger 52 acts as the condenser and the first adsorption heat exchanger 51 acts as the evaporator.

Figures 8A, 8B, 8C:
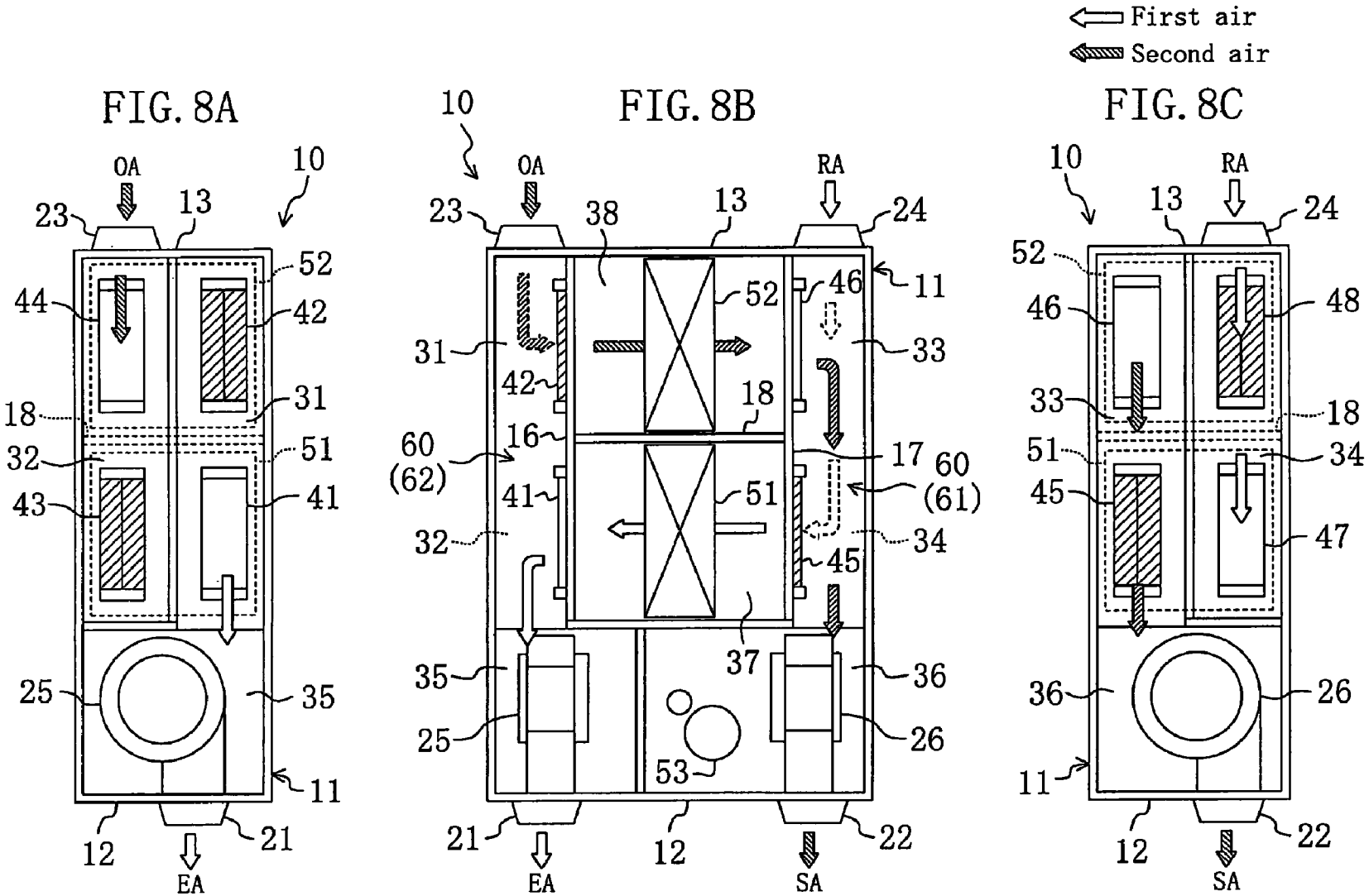
FIG. 8A is a construction diagram when viewed from the left side.
FIG. 8B is a construction diagram when viewed from the top side.
FIG. 8C is a construction diagram when viewed from the right side.

As shown in FIG. 8, during this second operation, only the first damper 41, the fourth damper 44, the sixth damper 46, and the seventh damper 47 are brought into an open state and the remaining dampers 42, 43, 45, and 48 are brought into a closed state.

The first air flowing into the inside air side passage 34 through the inside air suction port 24 passes through the seventh damper 47 and flows into the first heat exchanger chamber 37 and then passes through the first adsorption heat exchanger 51. In the first adsorption heat exchanger 51, moisture in the first air is adsorbed by the adsorbent and adsorption heat produced at this time is absorbed by the refrigerant. The first air dehumidified by the first adsorption heat exchanger 51 passes through the first damper 41 and flows into the exhaust side passage 31 and then passes through the exhaust fan chamber 35 and then passes through the exhaust port 21 and then is discharged to the outside of the room.

On the other hand, the second air flowing into the outside air side passage 32 through the outside air suction port 23 passes through the fourth damper 44 and flows into the second heat exchanger chamber 38 and then passes through the second adsorption heat exchanger 52. In the second adsorption heat exchanger 52, moisture is desorbed from the adsorbent heated by the refrigerant. This desorbed moisture is supplied to the second air. The second air humidified by the second adsorption heat exchanger 52 passes through the sixth damper 46 and flows into the air supply side passage 33 and then passes through the air supply fan chamber 36 and then passes through the air supply port 22 and then is supplied into the room.

During the humidifying operation mode, as described above, the first operation and the second operation are performed alternately at specified intervals (for example, at intervals of three minutes). In other words, in a period during which the second air is humidified by the adsorbent in the first adsorption heat exchanger 51 is performed the first operation in which moisture is supplied to the adsorbent in the second adsorption heat exchanger 52 by the first air, whereas in a period during which the second air is humidified by the adsorbent in the second adsorption heat exchanger 52 is performed the second operation in which moisture is supplied to the adsorbent in the first adsorption heat exchanger 51 by the first air. By operating these first and second operations alternately repeatedly, the interior of the room is continuously humidified.

<Cooling Operation Mode>

During the cooling operation mode, either the first operation or the second operation of the dehumidifying operation mode is selected and the selected operation is continuously performed. In other words, during the cooling operation mode, the switching between the first operation and the second operation is not done.

For example, when the first operation is continuously performed, the adsorbent in the second adsorption heat exchanger 52 adsorbs moisture in the first air at the beginning of the first operation and reaches a saturated state in a short time and does not further adsorb the moisture in the first air. When the first operation is further continuously performed in this state, the first air passing through the second adsorption heat exchanger 52 is subjected to only cooling treatment by the refrigerant flowing through the second adsorption heat exchanger 52. In other words, in this operation mode, the interior of the room is not dehumidified but is only cooled.

<Heating Operation Mode>

During the heating operation mode, either the first operation or the second operation of the humidifying operation mode is selected and the selected operation is continuously performed. In other words, during the heating operation mode, the switching between the first operation and the second operation is not done.

For example, when the first operation is continuously performed, the adsorbent in the first adsorption heat exchanger 51 supplies moisture to the second air at the beginning of the first operation and discharges all moisture in a short time and does not further supply the moisture to the second air. When the first operation is further continuously performed in this state, the second air passing through the first adsorption heat exchanger 51 is subjected to only heating treatment by the refrigerant flowing through the first adsorption heat exchanger 51. In other words, in this operation mode, the interior of the room is not humidified but is only heated.

<First Ventilating Operation Mode>

In the first operation of the dehumidifying operation mode and in the second operation of the humidifying operation mode, the flow of the air is the same except for a distinction between the first air (dehumidifying air) and the second air (humidifying air). Moreover, also in the second operation of the dehumidifying operation mode and in the first operation of the humidifying operation mode, the flow of the air is the same except for a distinction between the first air and the second air.

This first ventilating operation mode is an operation mode in which the refrigerant circuit 50 is stopped and in which only one of the first operation and the second operation is performed. In the first ventilating operation mode, the switching between the first operation and the second operation is not done. Thus, in this first ventilating operation mode, the outside air (OA) is only passed through the first adsorption heat exchanger 51 or the second adsorption heat exchanger 52 and is supplied into the room, and the room air (RA) is only passed through the second adsorption heat exchanger 52 or the first adsorption heat exchanger 51 and is discharged to the outside of the room. In this manner, simple ventilation is performed.

<Second Ventilating Operation Mode>

While the first ventilating operation mode is the operation mode in which the refrigerant circuit 50 is stopped and in which only one of the first operation and the second operation is performed, a second ventilating operation mode is an operation mode in which the refrigerant circuit 50 is stopped and in which the switching between the first operation and the second operation is done. Thus, in this second ventilating operation mode, the alternate switching between the adsorption heat exchangers 51 or 52 through which the outdoor air (OA) flows and the adsorption heat exchangers 51 or 52 through which the room air (RA) flows is done, so ventilation is performed while heat is exchanged in a pseudo manner between the outside air (OA) and the room air (RA).

<Switching of Operation Mode>

Next, the switching of the operation mode in the air conditioning system of this embodiment will be described.

This embodiment, as described above, is constructed so as to perform a total of six kinds of operation modes of: the dehumidifying operation mode and the humidifying operation mode which are performed in a state where the refrigerant flowing state and the air flowing state are switched at specified intervals; the cooling operation mode and the heating operation mode which are performed in a state where the refrigerant flowing state and the air flowing state are not switched but are fixed; the first ventilating operation mode performed while the air flowing state is fixed in a state where the refrigerant circuit 50 is stopped; and the second ventilating operation mode performed while the air flowing state is switched in a state where the refrigerant circuit 50 is stopped.

Figure 9:
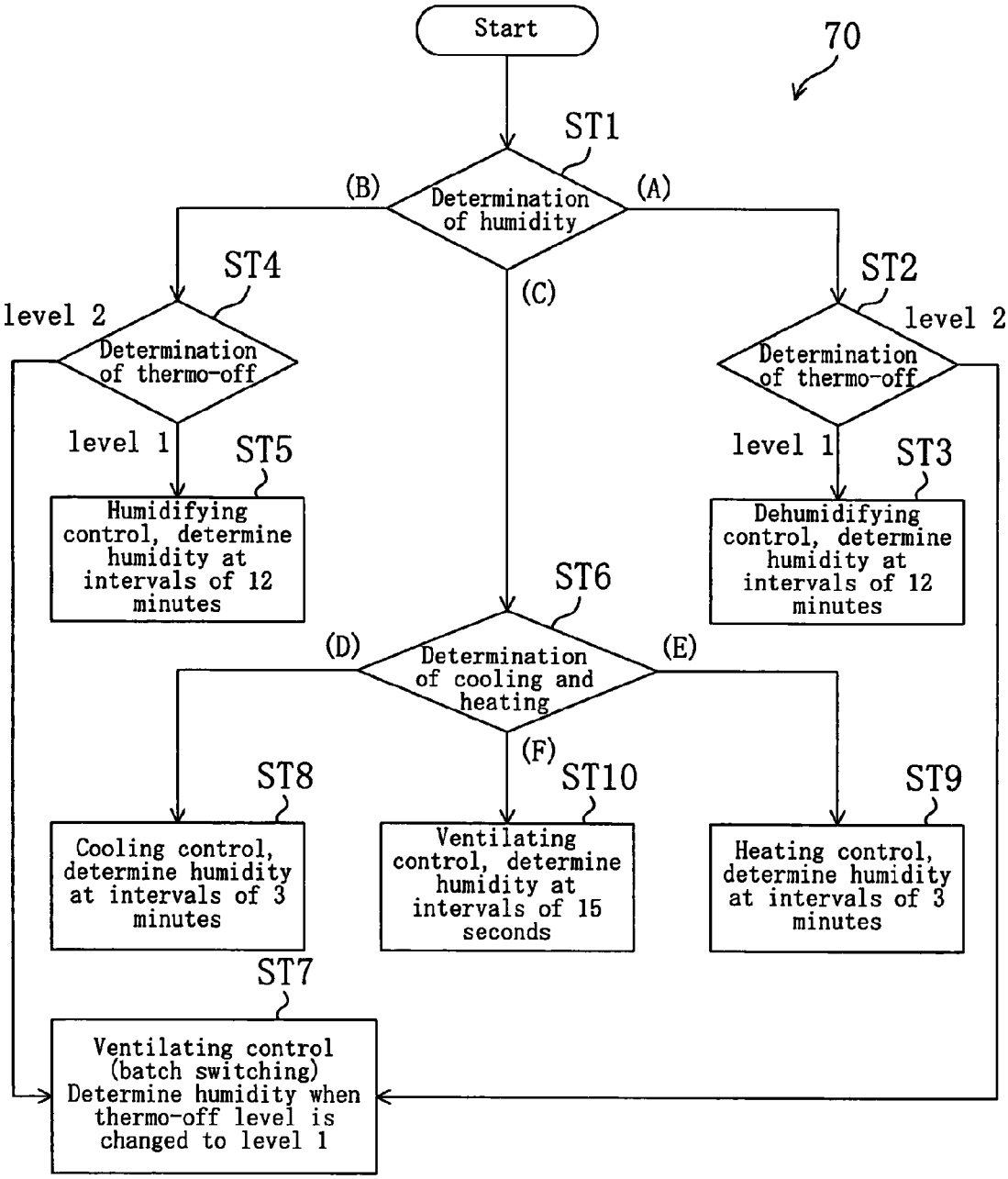
FIG. 9 is a flow chart showing the switching of an operation mode of the air conditioning system of the embodiment 1.

This air conditioning system is provided with control means for determining an optimal operation mode on the basis of at least the state quantity of the room air and the state quantity of the outside air and for setting an operation mode. The control contents of this control means 70 will be described below on the basis of a flow chart shown in FIG. 9.

In step ST1, the relationship between set humidity in the room and outside air humidity is determined. Here, under the ordinary condition, the set humidity is such that the relative humidity of the room air of set temperature is specified within a range of from a lower limit of 40% to an upper limit of 60%. In addition, under a lower humid condition, the set humidity is such that the relative humidity of the room air of set temperature is specified within a range of from a lower limit of 20% to an upper limit of 40%. In this flow chart, the operation under the ordinary condition will be described.

Of the determination results of step ST1, (A), shows a case in which the condition of outside air humidity >upper limit of set humidity is satisfied, (B) shows a case in which the condition of outside air humidity <lower limit of set humidity is satisfied, and (C) shows a case in which the condition of lower limit of set humidity <outside air humidity≦set humidity is satisfied.

When the determination result is A, the routine proceeds to step ST2 where it is determined whether or not the dehumidifying operation mode is performed. When the determination result is B, the routine proceeds to step ST4 where it is determined whether or not the humidifying operation mode is performed. When the determination result is C, the routine proceeds to step ST6 where it is determined whether or not the cooling operation mode and the heating operation mode are performed.

In step ST2, it is determined whether or not a thermo-off level is a level 1 or a level 2. When it is determined that the thermo-off level is not the level 2, the dehumidifying operation mode is performed. The determination of the thermo-off level is a determination for controlling the operating state of the compressor 53. For example, when the dehumidifying operation is performed under a condition in which the outside air is high in humidity and low in temperature, there is a possibility that the room temperature will become too low. Thus, when the room temperature becomes lower than a set room temperature, the frequency of the compressor 53 is decreased at the thermo-off level 1 to decrease an operating capacity and when the room temperature continuously becomes low even if the operating capacity is minimized, the compressor 53 is stopped at the thermo-off level 2.

When the determination result is not the thermo-off level 2 (including the thermo-off level 1), the routine proceeds to step ST3 where the dehumidifying operation mode is performed. In this dehumidifying operation mode, as described above, the switching between the first operation and the second operation is done at intervals of three minutes and the determination of humidity is made at intervals of twelve minutes just as with the step ST1 and the operation mode is switched according to the determination result.

It is determined in step ST4 whether the thermo-ff level is the level 1 or the level 2. When it is determined that the thermo-ff level is not the level 2, the humidifying operation mode is performed. The determination of the thermo-off level is a determination for controlling the operating state of the compressor 53. For example, when the humidifying operation is performed under a condition in which the outside air is low in humidity and high in temperature, there is a possibility that the room temperature will become too high. Thus, when the room temperature becomes higher than the set room temperature, the frequency of the compressor 53 is decreased at the thermo-off level 1 to decrease an operating capacity and when the room temperature continuously becomes high even if the operating capacity is minimized, the compressor 53 is stopped at the thermo-off level 2.

When the determination result is not the thermo-off level 2 (including the thermo-off level 1), the routine proceeds to step ST5 where the humidifying operation mode is performed. In this humidifying operation mode, as described above, the switching between the first operation and the second operation is done at intervals of three minutes and the determination of humidity is made at intervals of twelve minutes just as with the step ST1 and the operation mode is switched according to the determination result.

When it is determined in step ST2 and step ST4 that the thermo-off level is the level 2, although the compressor 53 is stopped, the room temperature becomes too low at the time of dehumidification and the room temperature becomes too high at the time of humidification. At this time, the interior of the room is brought into a state in which the dehumidifying operation mode and the humidifying operation mode are to be set but the interior of the room is brought into a state in which the room air is closer to the set humidity than the outside air. In these cases, the routine proceeds to step ST7 where the ventilating operation mode is performed.

It is under a condition in which the compressor 53 is not operated although the outside air humidity is out of the range of the set humidity that Step ST7 is performed. At this time, the second ventilating operation mode performed while the air flowing state is switched in a state where the refrigerant circuit 50 is stopped is performed. In this second ventilating operation mode, the sensible heat and the latent heat of the room air discharged to the outside of the room are supplied to one of the adsorption heat exchangers 51 and 52, for example, in the first operation and then when the first operation is switched to the second operation, the sensible heat and the latent heat of the room air are deprived by the air supplied from the outside of the room to the inside of the room in the one of the adsorption heat exchangers 51 and 52. Thus, the pseudo heat exchange ventilation can be performed by performing the first mode and the second mode alternately repeatedly.

During this second ventilating operation mode, the determination of the thermo-off level is continuously performed and when it is detected that the thermo-off level is changed to the level 1, the operation is returned to the determination of humidity.

When the determination result in step ST1 is C and the outside air humidity is between the upper limit and the lower limit of the set humidity, the routine proceeds to step ST6 where it is determined whether or not the cooling operation mode and the heating operation mode are performed. Of the determination results in this case, (D) shows a case in which three conditions of:

room temperature <outdoor temperature room temperature >set temperature dew-point temperature of outdoor air <outdoor temperature −15° C. are satisfied;

(E) shows a case in which three conditions of:

room temperature >outdoor temperature room temperature <set temperature dew-point temperature of room air <room air temperature −15° C. are satisfied; and (F) shows a case in which the conditions of D and E are not satisfied.

In the conditions of D and E, the preceding two conditions are especially important.

When the determination result is D, the routine proceeds to step ST8 where the control of the cooling operation mode is performed. When the determination result is E, the routine proceeds to step ST9 where the control of the heating operation mode is performed. When the determination result is F, the routine proceeds to step ST10 where the control of the ventilating operation mode is performed. The ventilating operation mode in step ST10 is a first ventilating operation mode in which the ventilating operation is performed while the air flowing state is fixed in a state where the refrigerant circuit 50 is stopped. At this time, the outside air humidity is within the set humidity and the cooling and the heating operations are not required, so only ventilating operation is simply performed in the first ventilating operation mode. At the time of the first ventilating operation mode, the determination of humidity is made at intervals of fifteen seconds, just as with the step ST1, and the operation mode is switched according to the determination result.

At the time of the cooling operation mode in step ST8, the determination of humidity is made at intervals of three minutes, just as with the step ST1, and the operation mode is switched according to the determination result. Moreover, at the time of this cooling operation mode, the control of setting the evaporation temperature of the refrigerant circuit 50 higher than the dew-point temperature of the outdoor air is performed by the control means 70. This is because when the evaporation temperature of the refrigerant circuit 50 becomes lower than the dew-point temperature of the outdoor air, the adsorption heat exchangers 51 and 52 produce drain water.

Further, during the cooling operation mode, when the evaporation temperature of the refrigerant circuit 50 reaches a target value and then the difference between high pressure and low pressure of the refrigerant circuit 50 is smaller than a specified pressure difference, the operation of stopping the compressor 53 and of prohibiting the cooling operation mode is started. This is because of the following reason: that is, since the evaporation temperature of the refrigerant circuit 50 needs to be surely made higher than the dew-point temperature of the outdoor air, if the refrigerant is circulated only in a state where the pressure difference of the refrigerant circuit 50 is not developed, the state being developed sometimes depending on the outside air condition, the compressor 53 is stopped while the refrigerant circuit 50 is not normally operated. In this case, it suffices to start the compressor 53 after a specified time passes.

Moreover, there is a possibility that the interior of the room will be made too cool to produce drain water under a condition in which the evaporation temperature of the refrigerant circuit 50 becomes lower than the dew-point temperature of the outdoor air in a state where the compressor 53 is operated at a minimum capacity in the cooling operation mode, so the compressor 53 is stopped and the cooling operation mode is prohibited.

At the time of the heating operation mode in step ST9, the determination of humidity is made at intervals of three minutes, just as with the step ST1, and the operation mode is switched according to the determination result. Moreover, at the time of this heating operation mode, the control of setting the evaporation temperature of the refrigerant circuit 50 higher than the dew-point temperature of the room air is performed by the control means 70. This is because when the evaporation temperature of the refrigerant circuit 50 becomes lower than the dew-point temperature of the room air, the adsorption heat exchangers 51 and 52 produce drain water.

Further, during the heating operation mode, when the evaporation temperature of the refrigerant circuit 50 reaches a target value and then the difference between the high pressure and the low pressure of the refrigerant circuit 50 is smaller than a specified pressure difference, the operation of stopping the compressor 53 and of prohibiting the heating operation mode is started. This is because of the same reason at the time of the cooling operation mode.

Moreover, even under a condition in which the evaporation temperature of the refrigerant circuit 50 becomes lower than the dew-point temperature of the room air in a state where the compressor 53 is operated at a minimum capacity in the heating operation mode, just as with the cooling operation mode, the compressor 53 is stopped and the heating operation mode is prohibited.

In this regard, the ventilating operation mode is divided into two modes in this embodiment, but if the ventilating operation mode is a mode of flowing air through the air passage 60 in a state where the refrigerant circuit 50 is stopped, the ventilating operation mode is not necessarily divided into two modes but one of the first ventilating operation mode and the second ventilating operation mode may be performed.

Effect of Embodiment

As described above, in this embodiment, the heat exchangers disposed in the refrigerant circuit 50 are only two adsorption heat exchangers 51 and 53. If the first operation and the second operation are alternately switched from each other in a state where the refrigerant circuit 50 is operated, the dehumidifying operation mode and the humidifying operation mode can be performed. If the switching between the first operation and the second operation is not done in a state where the refrigerant circuit 50 is operated, the cooling operation mode and the heating operation mode can be performed. If the switching between the first operation and the second operation is not done in a state where the refrigerant circuit 50 is stopped, the first ventilating operation mode can be performed. If the first operation and the second operation are alternately switched from each other in a state where the refrigerant circuit 50 is stopped, the second ventilating operation mode can be performed.

In this manner, this embodiment is simple in the construction of the refrigerant circuit 50 and can respond to six operation modes only by selecting the refrigerant flowing state from a flowing state or a stopping state and by selecting the air flowing state from a switching state or a fixed state. In other words, this embodiment is simple in the construction and control of the air conditioning system but can respond to a variety of operation modes.

Other Embodiments

In the above-mentioned embodiment, the air conditioner 10 may be constructed in the following manner. Here, modifications of the air conditioner 10 will be described.

-First Modification-

As shown in FIG. 10, the air conditioner 10 of a first modification has a refrigerant circuit 100 and two adsorption elements 111, 112. The refrigerant circuit 100 is a closed circuit in which a compressor 101, a condenser 102, an expansion valve 103, and an evaporator 104 are connected to each other in this order. When the refrigerant is circulated in the refrigerant circuit 100, a vapor compression type refrigeration cycle is performed. This refrigerant circuit 100 constructs heat source means for heating at least the adsorption elements 111, 112. The first adsorption element 111 and the second adsorption element 112 have adsorbents such as zeolite and construct a first adsorbent member and a second adsorbent member. Moreover, the respective adsorption elements 111, 112 have many air pores formed therein and when air passes through these air pores, the air is brought into contact with the adsorbent.

Figure 10A:
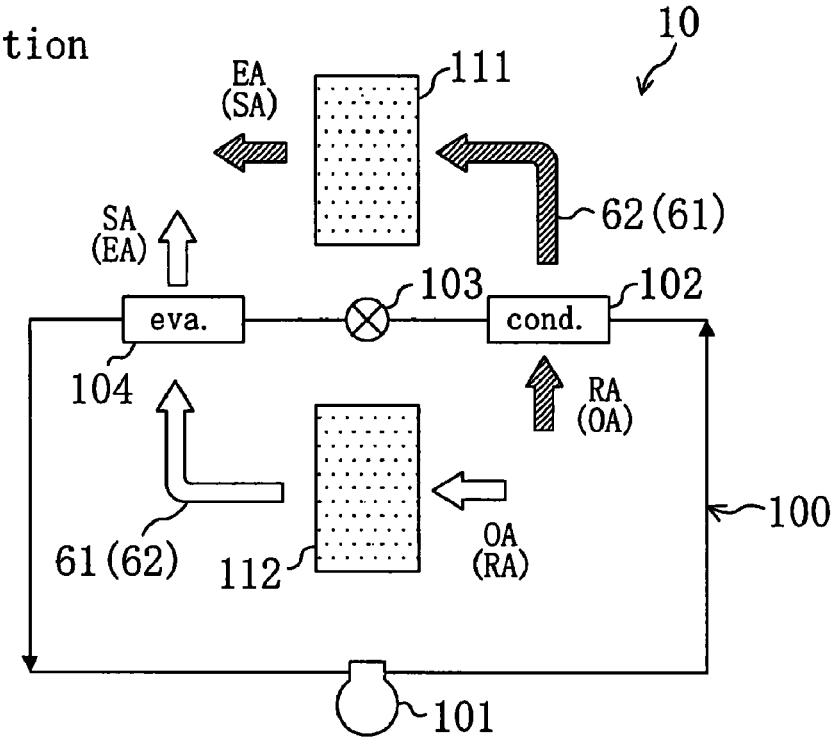
FIG. 10A is a diagram showing an operation during a first operation and FIG. 10B is a diagram showing an operation during a second operation.
Figure 10B:
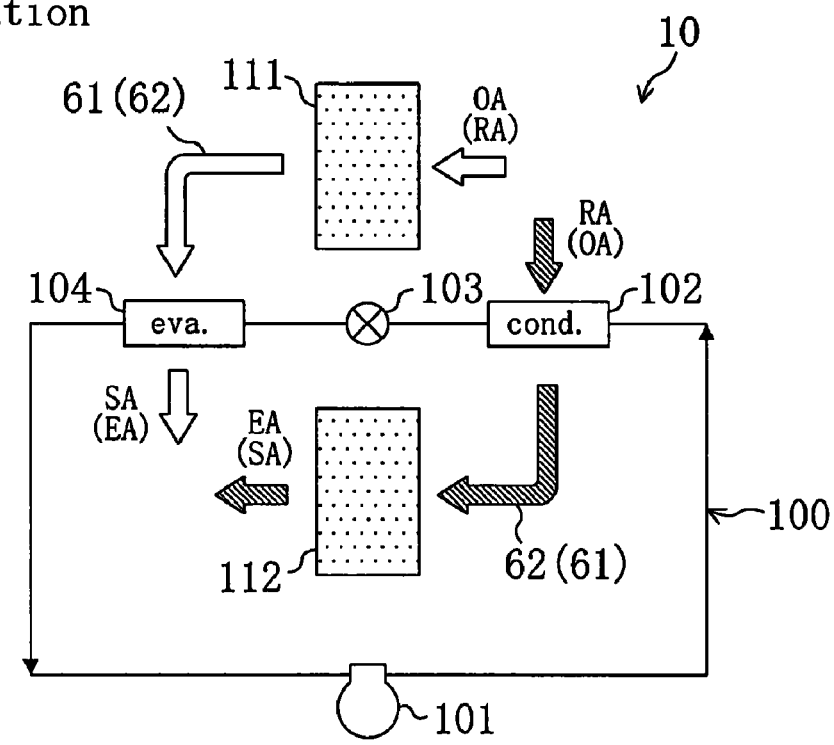

This air conditioner 10 switches the air passage 60 to perform a first operation and a second operation. As shown in FIG. 10A, the air conditioner 10 during the first operation supplies air heated by the condenser 102 to the first adsorption element 111 to regenerate the adsorbent, whereas the air conditioner 10 cools the air whose moisture is removed by the second adsorption element 112 by the evaporator 104. Moreover, as shown in FIG. 10B, the air conditioner 10 during the second operation supplies air heated by the condenser 102 to the second adsorption element 112 to regenerate the adsorbent, whereas the air conditioner 10 cools the air whose moisture is removed by the first adsorption element 111 by the evaporator 104.

Summarizing the above description, this air conditioner 10 is constructed as an air conditioning system including: an air passage 60 having a first passage 61 in which outside air flows into the room and a second passage 62 in which room air flows outside the room; the condenser 102 of a heater that is disposed in the air passage 60 and heats air; the evaporator 104 of a cooler that is disposed in the air passage 60 and cools air; and the first adsorption element 111 and the second adsorption element 112 that are disposed in the air passage 60 and adsorb moisture in air and discharge moisture into air.

The air passage 60 is constructed so as to switch a first operating state, in which air flowing from the outside of the room to the inside of the room passes through the first adsorption element 111 or the second adsorption element 112 and the evaporator 104 (the order may be reversed) and in which air flowing from the inside of the room to the outside of the room passes through the condenser 102, and the second adsorption element 112 or the first adsorption element 111, and a second operating state, in which air flowing from the outside of the room to the inside of the room passes through the condenser 102 and the first adsorption element 111 or the second adsorption element 112 and in which air flowing from the inside of the room to the outside of the room passes through the second adsorption element 112 or the first adsorption element 111 and the evaporator 104 (the order may be reversed).

Also the air conditioning system of this first modification is provided with control means (not shown) for determining an optimal operation mode on the basis of at least the state quantity of the room air and the state quantity of the outdoor air and for setting an operating mode and is constructed so as to automatically switch between the dehumidifying operation mode and the humidifying operation mode performed by switching the flow of air at specified intervals in the respective operating states, the cooling operation mode and the heating operating mode performed not by switching but by fixing the flow of air in the respective operating states, and the ventilating operation modes performed by flowing air through the air passage 60 in a state where the condenser 102 and the evaporator 104 are stopped.

In this regard, as for the ventilating operation mode, just as with the above-mentioned embodiment, it suffices to perform the first ventilating operation mode, which is performed while the condenser 102 and the evaporator 104 are stopped and the flow of air is fixed in the respective operation modes, and the second ventilating operation mode, which is performed while the condenser 102 and the evaporator 104 are stopped and the flow of air is switched in the respective operation modes.

The specific descriptions relating to the states of the operations in the respective operation modes and the switching of the respective operation modes will be omitted here. However, it suffices to determine the specific contents of the operations and the switching conditions as appropriate according to the construction of the air conditioner and the installation condition thereof.

Moreover, in this first modification, the heater is constructed of the condenser 102 of the refrigerant circuit 100 and the cooler is constructed of the evaporator 104. However, the heater may be constructed of a heat radiation side heat exchanger in a heating medium circuit other than the refrigerant circuit 100 such as a cold/warm water circuit in which cold warm water flows and a cooler may be constructed of a heat absorption side heat exchanger in this heating medium circuit.

-Second Modification-

Figure 11:
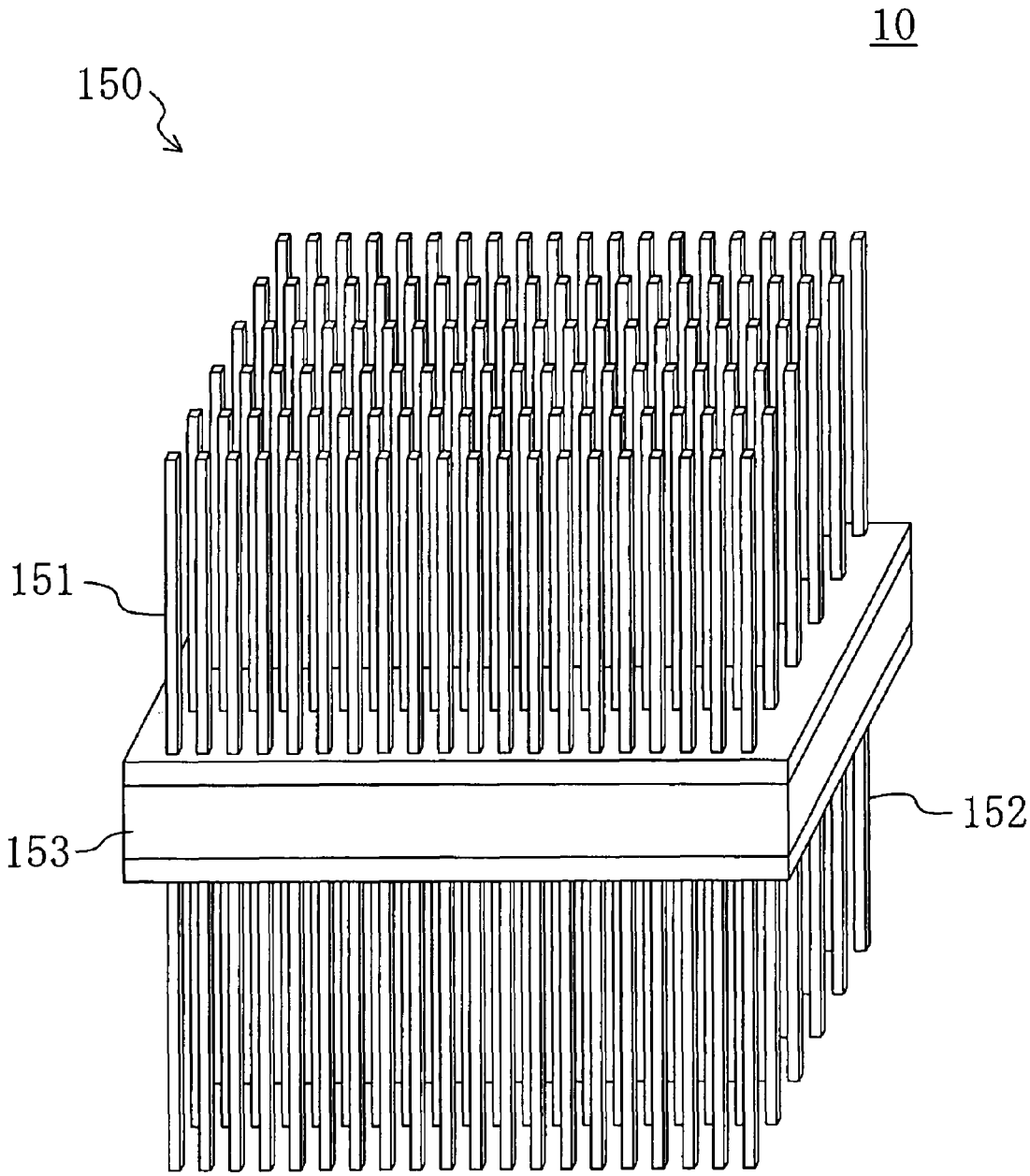
FIG. 11 is a schematic perspective view of an air conditioning unit in a second modification of the other embodiment.

As shown in FIG. 11, the air conditioner 10 constructing an air conditioning system of a second modification has an air conditioning unit 150. This air conditioning unit 150 has a Peltier effect device 153 and a pair of adsorption fins 151 and 152. The Peltier effect device 153 has a first surface and a second surface switched between a heat radiation side and a heat absorption side by switching the polarity of an applied direct current source between plus and minus. The adsorption fins 151 and 152 are members in which an adsorbent such as zeolite is supported on the surface of a so-called heat sink. In this regard, in some cases, the adsorbent may be directly supported on the surface of the Peltier effect device 153.

These adsorption fins 151, 152 construct two adsorbent members. In the Peltier effect device 153, the first adsorption fins 151 of first adsorbent members are joined to the first surface and the second adsorption fins 152 of second adsorbent members are joined to the second surface, respectively. When a direct current is passed through the Peltier effect device 153, one of the two adsorption fins 151, 152 becomes a heat absorption side and the other becomes a heat radiation side. In other words, a heater is constructed of the heat radiation side of the Peltier effect device 153 and a cooler is constructed of the heat absorption side of the Peltier effect device 153. Thus, the Peltier effect device 153 has both of the function of the cooler for cooling the first adsorption fins 151 and the second adsorption fins 152 and the function of the heater for heating the first adsorption fins 151 and the second adsorption fins 152.

This air conditioner 10 performs the first operation and the second operation repeatedly. The air conditioning unit 150 during the first operation heats the first adsorption fins 151 acting as the heat radiation side whereas cools the second adsorption fin 152 acting as the heat absorption side. Moreover, the air conditioning unit 150 during the second operation heats the second adsorption fins 152 acting as the heat radiation side and cools the first adsorption fin 151 acting as the heat absorption side.

Although not shown, the air conditioning system of this second modification has an air passage having a first passage in which the outdoor air flows to the inside of the room and a second passage in which the room air flows to the outside of the room. In the above-mentioned air conditioning unit 150, the first adsorption fins 151 disposed on the first surface of the Peltier effect device 153 are located in the first passage and the second adsorption fins 152 disposed on the second surface of the Peltier effect device 153 are located in the second passage.

The above-mentioned air passage is constructed so as to be able to switch between a first operating state, in which air flowing from the outside of the room to the inside of the room passes through the first adsorption fins 151 or the second absorption fins 152 acting as the heat absorption side and in which air flowing from the inside of the room to the outside of the room passes through the second adsorption fins 152 or the first absorption fins 151 acting as the heat radiation side, and a second operating state, in which air flowing from the outside of the room to the inside of the room passes through the first adsorption fins 151 or the second absorption fins 152 acting as the heat radiation side and in which air flowing from the inside of the room to the outside of the room passes through the second adsorption fins 152 or the first absorption fins 151 acting as the heat absorption side.

Also the air conditioning system of this second modification is provided with control means (not shown) for determining an optimal operation mode on the basis of at least the state quantity of the room air and the state quantity of the outdoor air and for setting an operating mode and is constructed so as to automatically switch between the dehumidifying operation mode and the humidifying operation mode performed by switching the flow of air at specified intervals in the respective operating states, the cooling operation mode and the heating operating mode performed not by switching but by fixing the flow of air in the respective operating states, and the ventilating operation modes performed by flowing air through the air passage in a state where the heater and the cooler are stopped.

In this regard, as for the ventilating operation mode, just as with the above-mentioned embodiment, it suffices to perform the first ventilating operation mode, which is performed while the heater and the cooler are stopped and the flow of air is fixed in the respective operation modes, and the second ventilating operation mode, which is performed while the heater and the cooler are stopped and the flow of air is switched in the respective operation modes.

The specific descriptions relating to the states of the operations in the respective operation modes and the switching of the respective operation modes will be omitted also in this second modification. However, it suffices to determine the specific contents of the operations and the switching conditions as appropriate according to the construction of the air conditioner and the installation condition thereof.

Also the above-mentioned two modifications can prevent the construction of the air conditioning system from becoming complex and can respond to a variety of operation modes.

In this regard, the above-mentioned embodiments are essentially preferable examples and are not intended to limit the scopes of the present invention, the applications of the invention, or the use of the invention.

INDUSTRIAL APPLICABILITY

As described hereinbefore, the present invention is useful for an air conditioning system using an condenser and an evaporator (or a heater and a cooler corresponding to them) of a refrigerant circuit and an adsorbent capable of adsorbing moisture in air and releasing moisture into air.

The invention claimed is:

1. An air conditioning system comprising:

an air passage having a first passage in which outdoor air flows to an inside of a room and a second passage in which room air flows to an outside of the room;

a refrigerant circuit for performing a vapor compression type refrigeration cycle; and an adsorbent capable of adsorbing moisture in air and releasing moisture into the air, wherein:

a heat exchanger of the refrigerant circuit is constructed of a first adsorption heat exchanger and a second adsorption heat exchanger which have the adsorbent supported on their surfaces;

the refrigerant circuit is constructed so as to be able to switch between a first refrigerant flowing state, in which the first adsorption heat exchanger acts as an evaporator and in which the second adsorption heat exchanger acts as a condenser, and a second refrigerant flowing state, in which the second adsorption heat exchanger acts as an evaporator and in which the first adsorption heat exchanger acts as a condenser;

the air passage is constructed so as to be able to switch between a first air flowing state, in which air flowing from the outside of the room to the inside of the room passes through the first adsorption heat exchanger and in which air flowing from the inside of the room to the outside of the room passes through the second adsorption heat exchanger, and a second air flowing state, in which the air flowing from the outside of the room to the inside of the room passes through the second adsorption heat exchanger and in which the air flowing from the inside of the room to the outside of the room passes through the first adsorption heat exchanger; and wherein the air conditioning system is configured to perform:

a dehumidifying operation mode and a humidifying operation mode which are performed by switching the refrigerant flowing state and the air flowing state at specified intervals;

a cooling operation mode and a heating operation mode which are performed not by switching but by fixing the refrigerant flowing state and the air flowing state; and a ventilating control operation which is performed by flowing air through the air passage in a state where the refrigerant circuit is stopped.

2. The air conditioning system according to claim 1, comprising:

a control means that determines an optimal operation mode on the basis of at least a state of the room air and a state of the outdoor air and sets an operation mode.

3. The air conditioning system according to claim 2, wherein:

the control means is constructed so as to be able to perform the dehumidifying operation mode when an outside air humidity is higher than an upper limit of a set humidity and to perform the humidifying operation mode when the outside air humidity is lower than a lower limit of the set humidity.

4. The air conditioning system according to claim 2, wherein:

the control means is constructed so as to be able to perform the cooling operation mode and the heating operation mode when an outside air humidity is between an upper limit and a lower limit of a set humidity.

5. The air conditioning system according to claim 4, wherein:

the control means is constructed so as to set the cooling operation mode when a room temperature is lower than an outdoor temperature and is higher than a set temperature and to set the heating operation mode when the room temperature is higher than the outdoor temperature and is lower than the set temperature.

6. The air conditioning system according to claim 5, wherein:

the control means is constructed so as to set an evaporation temperature of the refrigerant circuit in the cooling operation mode higher than a dew-point temperature of the outdoor air and to set the evaporation temperature of the refrigerant circuit in the heating operation mode higher than a dew-point temperature of the room air.

7. The air conditioning system according to claim 5, wherein:

when the evaporation temperature of the refrigerant circuit in the cooling operation mode reaches a target value and then a difference between a high pressure and a low pressure of the refrigerant circuit is smaller than a specified pressure difference, a compressor of the refrigerant circuit is stopped to prohibit the cooling operation mode, and when the evaporation temperature of the refrigerant circuit in the heating operation mode reaches a target value and then the difference between the high pressure and the low pressure of the refrigerant circuit is smaller than a specified pressure difference, the compressor of the refrigerant circuit is stopped to prohibit the heating operation mode.

8. The air conditioning system according to claim 5, wherein:

the compressor of the refrigerant circuit is constructed of a variable displacement compressor;

the compressor is stopped to prohibit the cooling operation mode under a condition in which the evaporation temperature of the refrigerant circuit is lower than a dew-point temperature of the outdoor air in a state where the compressor is operated at a minimum capacity in the cooling operation mode, and the compressor is stopped to prohibit the heating operation mode under a condition in which the evaporation temperature of the refrigerant circuit is lower than a dew-point temperature of the room air in a state where the compressor is operated at a minimum capacity in the heating operation mode.

9. The air conditioning system according to claim 5, wherein:

the control means is constructed so as to perform a ventilating control operation under a condition in which the cooling operation mode and the heating operation mode are not set, the ventilating control operation being a first ventilating operation mode performed while the air flowing state is fixed in a state where the refrigerant circuit is stopped.

10. The air conditioning system according to claim 3, wherein:

the control means is constructed so as to perform the ventilating control operation when the room air is closer to the set humidity than the outdoor air, in a state satisfying a condition in which the dehumidifying operation mode or the humidifying operation mode is set, the ventilating control operation being a second ventilating operation mode performed while the air flowing state is switched in a state where the refrigerant circuit is stopped.

* * * * *